US010639238B2

(12) United States Patent
Donschietz et al.

(10) Patent No.: US 10,639,238 B2
(45) Date of Patent: May 5, 2020

(54) PASSIVE COLD STORAGE CONTAINER SYSTEMS WITH PACKAGING TRAY AND RETENTION PLATE

(71) Applicant: FISHER CLINICAL SERVICES, INC., Allentown, PA (US)

(72) Inventors: Michael T. Donschietz, Allentown, PA (US); Gregory L. Heintzelman, Kempton, PA (US)

(73) Assignee: Fisher Clinical Services, Inc., Allentown, PA (US)

( * ) Notice: Subject to any disclaimer, the term of this patent is extended or adjusted under 35 U.S.C. 154(b) by 1033 days.

(21) Appl. No.: 15/066,673

(22) Filed: Mar. 10, 2016

(65) Prior Publication Data

US 2016/0262978 A1 Sep. 15, 2016

Related U.S. Application Data

(63) Continuation-in-part of application No. 29/520,442, filed on Mar. 15, 2015, now Pat. No. Des. 752,437.

(60) Provisional application No. 62/160,987, filed on May 13, 2015.

(51) Int. Cl.
*A61J 1/16* (2006.01)

(52) U.S. Cl.
CPC ..... *A61J 1/165* (2013.01)

(58) Field of Classification Search
CPC ..... B65D 81/38; B65D 5/04; B65D 21/0223; B65D 21/0217; B65D 21/0219; A61J 1/16; A61J 1/1493
USPC ..... 220/592.2, 4.27, 4.26, 781, 380; 206/438, 557, 507–509, 505
See application file for complete search history.

(56) References Cited

U.S. PATENT DOCUMENTS

| | | | | |
|---|---|---|---|---|
| D138,782 | S | 9/1944 | Schwartzbert | |
| D193,448 | S * | 8/1962 | Theilig | D9/456 |
| D225,836 | S | 1/1973 | Boyd | |
| D229,674 | S | 12/1973 | Quigg | |
| D254,956 | S | 5/1980 | Gilley | |
| D360,825 | S | 8/1995 | Knoss | |
| D379,717 | S | 6/1997 | Apps | |
| D465,417 | S | 11/2002 | Apps | |

(Continued)

OTHER PUBLICATIONS

Barger Thermoform Packaging: announced Oct. 14, 2014 [online], cite visited [Jan. 19, 2016], Available from Internet URL:http://www.bargerpackaging.com/resource-center/packaging-gallery/.

(Continued)

*Primary Examiner* — Anthony D Stashick
*Assistant Examiner* — Raven Collins
(74) *Attorney, Agent, or Firm* — Workman Nydegger

(57) ABSTRACT

A passive cold storage container system includes a container bounding a storage area with at least one heat sink module disposed therein. A first storage unit having a compartment is also disposed within the storage area. A first tray is removably disposed within the compartment of the first storage unit, the first tray having a floor with a top surface and a plurality of spacers upstanding from the top surface of the floor and being spaced apart. A plurality of medicinal carriers are disposed on the first tray between the spacers, each medicinal carrier housing a medicinal preparation. A first retention plate is disposed within the compartment of the first storage unit and is positioned over the plurality of medicinal carriers.

18 Claims, 15 Drawing Sheets

(56) References Cited

U.S. PATENT DOCUMENTS

| | | | | |
|---|---|---|---|---|
| D485,756 | S | 1/2004 | Apps | |
| D505,014 | S | 5/2005 | Apps | |
| D524,651 | S | 7/2006 | Apps | |
| D529,401 | S | 10/2006 | Aoki | |
| D535,881 | S | 1/2007 | Liukko | |
| D587,116 | S | 2/2009 | Landry | |
| D590,715 | S | 4/2009 | Gilfert | |
| D620,605 | S | 7/2010 | Reitze | |
| D645,156 | S | 9/2011 | Reitze | |
| 8,069,680 | B2 | 12/2011 | Hyde et al. | |
| 8,100,263 | B2 * | 1/2012 | Vanderbush | A61M 5/002 206/366 |
| 8,101,293 | B2 | 1/2012 | Chan et al. | |
| D658,989 | S | 5/2012 | Nelissen | |
| 8,211,516 | B2 | 7/2012 | Bowers et al. | |
| 8,215,518 | B2 | 7/2012 | Hyde et al. | |
| 8,215,835 | B2 | 7/2012 | Hyde et al. | |
| 8,322,147 | B2 | 12/2012 | Hyde et al. | |
| 8,377,030 | B2 | 2/2013 | Hyde et al. | |
| D683,541 | S | 6/2013 | Lindstrom | |
| 8,485,387 | B2 | 7/2013 | Bowers et al. | |
| 8,603,598 | B2 | 12/2013 | Hyde et al. | |
| 8,703,259 | B2 | 4/2014 | Bowers et al. | |
| D732,187 | S | 6/2015 | Houkal | |
| D743,793 | S | 11/2015 | Prince | |
| D743,794 | S | 11/2015 | Carroll | |
| 9,718,583 | B2 * | 8/2017 | Nicoletti | A61M 5/002 |
| 2005/0269239 | A1 | 12/2005 | Apps | |
| 2006/0213206 | A1 * | 9/2006 | Linder | F25B 21/02 62/3.6 |
| 2009/0145164 | A1 | 6/2009 | Hyde et al. | |
| 2009/0145912 | A1 | 6/2009 | Hyde et al. | |
| 2010/0213200 | A1 | 8/2010 | Deane et al. | |
| 2011/0127273 | A1 | 6/2011 | Deane et al. | |
| 2011/0155745 | A1 | 6/2011 | Chou et al. | |
| 2012/0000918 | A1 | 1/2012 | Deane et al. | |
| 2012/0085070 | A1 | 4/2012 | Chou et al. | |
| 2012/0097686 | A1 | 4/2012 | Hyde et al. | |
| 2012/0168448 | A1 | 7/2012 | Hyde et al. | |
| 2013/0119072 | A1 | 5/2013 | Hyde et al. | |
| 2013/0161225 | A1 * | 6/2013 | Lepot | A61M 5/001 206/557 |
| 2013/0265145 | A1 | 10/2013 | Bowers et al. | |
| 2013/0306656 | A1 | 11/2013 | Eckhoff et al. | |
| 2014/0053970 | A1 | 2/2014 | Hyde et al. | |
| 2014/0057073 | A1 | 2/2014 | Hyde et al. | |
| 2014/0150464 | A1 | 6/2014 | Bloedow et al. | |
| 2014/0190861 | A1 * | 7/2014 | Carrel | A61M 5/002 206/518 |
| 2014/0352329 | A1 | 12/2014 | Bloedow et al. | |

OTHER PUBLICATIONS

Laura Bowen, *Portable Cordless Vaccine Storage Device*, COMSOL Blog, Jun. 14, 2014, 3 pages.

Laura Bowen, *Innovative Thermal Insulation Techniques Bring Vaccines to the Developing World*, COMSOL News, 2014, pp. 18 and 19.

*Milestones Met for Vaccine Logistics*, IV Insights Blog, Feb. 20, 2015, 3 pages.

*Passive Vaccine Storage Device in COMSOL News*, PVSD in COMSOL News, as early as Apr. 29, 2015, 2 pages.

*Passive Vaccine Storage Device*, Intellectual Ventures, as early as Apr. 29, 2015, 2 pages.

R&D Magazine, *Saving Children's Lives*, Aug. 21, 2014, 2 pages.

* cited by examiner

PASSIVE COLD STORAGE CONTAINER SYSTEMS WITH PACKAGING TRAY AND RETENTION PLATE

CROSS-REFERENCE TO RELATED APPLICATIONS

This application is a continuation-in-part of U.S. Design application No. 29/520,442, filed Mar. 13, 2015, and claims the benefit of U.S. Provisional Application No. 62/160,987, filed May 13, 2015, which are incorporated herein by specific reference.

BACKGROUND OF THE INVENTION

1. The Field of the Invention

The present invention relates to passive cold storage container systems for use in storing and transporting medicinal preparations and, more particularly, to packaging trays and retention plates thereof that are used for loading and holding the medicinal carriers.

2. The Relevant Technology

It is estimated that over one million children die each year from vaccine-preventable diseases. Such deaths are largely a result of the inability to store vaccines for extended periods of time without conventional refrigeration systems that require electricity. One of the difficulties with live vaccines is that once they are produced they must be continually maintained at very low temperatures, typically in a range between −10° C. and 0° C., until just prior to being administered. Once a vaccine starts to warm, it quickly deteriorates and becomes ineffective. Most of the children who die from vaccine-preventable diseases live in third-world countries where electricity is sparse or intermittent, making it difficult or impossible to use conventional refrigeration systems to store vaccine. Conventional cold storage containers, which do not require electricity, have been used to transport vaccines. Such containers, however, can typically only maintain the required temperature for a few days.

To overcome the above problems, an improved passive cold storage container system has been developed that is able to hold multiple vials of vaccine at a temperature range between −10° C. and 0° C. for a period of often up to 2-3 months without connecting to an external electrical source, even when the container system is opened repeatedly to access and remove vials of vaccine. Depicted in FIG. 1 an improved passive cold storage container system 10. Container system 10 comprises a container 12, a plurality of storage racks 14, and a plurality of heat sink modules 16. Storage racks 14 are used to house a plurality of vials 18 in which a vaccine is stored. During use, heat sink modules 16 and storage racks 14 housing vials 18 are disposed within container 12.

As depicted in FIGS. 1 and 2, container 12 comprises body 20 having an outer wall 22 with a generally cylindrical configuration that extends between an upper end 24 and an opposing lower end 26. Upper end 24 inwardly tapers to an access opening 28. An enlarged head 32 encircles and radially outwardly projects from upper end 24 of exterior wall 22 while an enlarged head 34 encircles and radially outwardly projects from lower end 26 of exterior wall 22. As a result, container 12 has a generally dumbbell shaped configuration. Heads 32 and 34 can be made of an elastomeric material, such as rubber, and function to weight and stabilize body 20 so that container 12 is easily retained and supported in the depicted vertical orientation. Heads 32 and 34 also function as bumpers to minimize any jarring or impact on body 20 and vials 18 stored therein and also help to insulate body 20.

Container 12 also has an inner wall 36 that is encircled by and spaced apart from outer wall 22. A gap 38 is formed between inner wall 36 and outer wall 22 so that no direct contact is formed between walls 22 and 36. This configuration helps to minimize any heat transfer between walls 22 and 36. Inner wall 36 bounds a storage area 37 having a cylindrical configuration that extends between an upper end 40 and an opposing lower end 42. An opening 44 is formed at upper end 40 of inner wall 36 and communicates with storage area 37. Opening 44 of inner wall 36 is vertically aligned with access opening 28 of outer wall 22 with a tubular connector 46 extending therebetween. Tubular connector 46 is typically formed as a flexible member and bounds a conduit 48 that extends along the length thereof and communicates with storage area 37. Tubular connector 46 and conduit 48 are constricted relative to storage area 37 so as to minimize the heat transfer that can pass therethrough. As depicted in FIGS. 2 and 3, a cap 50 having an insulated base 52 can be removably received within conduct 48 of connector 46 and secured in place so as to selectively seal conduit 48 closed.

Inner wall 36, outer wall 22, and connector 46 can be made of a variety of different materials including composites or layers of materials. For example, walls 22 and 36 and connector 46 can be made from plastic, fiberglass, or metals, such as aluminum or stainless steel or combinations of the foregoing. In one embodiment, outer wall 22 is fabricated from stainless steel with an outer layer of plastic while inner wall 36 is fabricated from stainless steel with an interior coating of plastic, rubber, foam or other material suitable to provide support and insulation to material stored within storage area 37.

Disposed within gap 38 between walls 22 and 36 is at least one section of an ultra efficient insulation material. The term "ultra efficient insulation material," as used herein, may include one or more type of insulation material with extremely low heat conductance and extremely low heat radiation transfer between the surfaces of the insulation material. The ultra efficient insulation material may include, for example, one or more layers of thermally reflective film, a high vacuum area, aerogel, low thermal conductivity bead-like units, disordered layered crystals, low density solids, or low density foam. Specific examples and other alternatives for ultra efficient insulation materials are disclosed in U.S. Patent Publication No. 2011/0127273, published Jun. 2, 2011.

During operation, as depicted in FIG. 2, heat sink modules 16 are stacked on opposing sides of storage area 37 so that storage racks 14 can be centrally positioned between heat sink modules 16. Turning to FIG. 4, heat sink modules 16 comprises a shell 54 having an interior surface 55 that bounds a cavity 56. Shell 54 for heat sink modules 16 is typically comprised of a metal, such as stainless steel or aluminum, or a plastic, such as polyethylene or polypropylene.

Cavity 56 is at least partially filled with a material that will absorb thermal energy, such as when the material undergoes a phase change. For example, the material can be frozen water or other types of ice; frozen material that is generally gaseous at ambient temperatures and pressure, such as frozen carbon dioxide ($CO_2$); liquid material that is generally gaseous at ambient temperature and pressure, such as liquid nitrogen; artificial gels or composites with heat sink properties; phase change materials; and refrigerants. Specific examples and other materials that can be used are disclosed in U.S. Patent Publication No. 2011/0127273 and the "phase change materials" discussed in U.S. Patent Publication No. 2014/0150464, published Jun. 5, 2014.

Each heat sink module 16 is depicted as having a substantially semicircular configuration with a flat inside face 57 and an arched outside face 58 that extends between opposing ends thereof. Faces 57 and 58 likewise extend between a substantially flat top surface 59 and a substantially flat bottom surface 60. As depicted in FIG. 2, heat sink modules 16 are sized so that they can be manually inserted and removed from storage area 37 through constricted conduit 48. The semicircular configuration allows heat sink modules 16 to fit flushed against the interior surface of inner wall 36 to maximize filling of storage area 37 but yet still allow room for storage racks 14.

As depicted in FIGS. 2 and 4, storage racks 14A, 14B and 14C are housed within storage area 37 between heat sink modules 16. As depicted in FIG. 5, each storage rack 14 comprises a plurality of storage units 61, such as storage units 61A-61D, and a lid 62. Storage units 61A-61D and lid 62 can be vertically stacked and selectively locked together so as to form storage rack 14. As a result of storage units 61 and lid 62 being locked together, by lifting a handle 63 on lid 62, the entire storage rack 14 can be lifted. Each storage rack 14 is sized so that it can pass through conduit 48 of connector 46 (FIG. 2) and be completely housed within storage area 37 of container 12.

As depicted in FIGS. 6 and 7, each storage unit 61 has an encircling side wall 64 that comprises a front wall 66 and an opposing back wall 67 that extend between opposing side walls 68 and 69. Walls 66-69 are substantially planer and intersect at rounded corners 71. Encircling side wall 64 has an upper end 70 that terminates at a top edge 72 and a lower end 74 that terminates at a bottom end wall 76. Encircling side wall 64 has an interior surface 78 that bounds a compartment 80. Compartment 80 has a substantially cubic configuration with rounded corners. Compartment 80 is sized to house a plurality of vials 18 (FIG. 5) containing a vaccine. Top edge 72 encircles compartment 80 and bounds an access opening thereto. Formed on interior surface 78 of each wall 66-69 is a recessed engagement notch 82.

As depicted in FIG. 7, projecting from bottom end wall 76 of storage unit 61 is a cylindrical stem 86. Radially outwardly projecting from a lower end of stem 86 are four radially spaced apart tabs 88A-D. Each tab 88 is positioned so as to be centrally disposed below a corresponding one of wall 66-69. Tabs 88 are configured to removably interlock stacked storage units 61A-D. For example, with reference to FIG. 5, during assembly storage unit 61A is received on top of storage unit 61B so that stem 86 of storage unit 61A is received within compartment 80 of storage unit 62B. In this position, storage unit 62A and 62B are rotationally offset from one another so that the tabs 88 (FIG. 7) are more aligned towards the rounded corners 71 of storage unit 61B. Once stem 86 is received within compartment 80 and bottom end wall 76 of storage unit 61A is resting on top edge 72 of storage unit 61B, storage unit 61A can be rotated relative to storage unit 61B so that tabs 88A-D (FIG. 7) are received within corresponding engagement notches 82, thereby securing storage unit 61A and 61B together. As needed, storage unit 61 can be separated by reversing the rotation. Storage units 61C and 61D can be similarly coupled in sequence to storage unit 61B. Lid 62 has the same configuration as storage units 61 except that encircling side wall 64 is shorter on lid 62 and handle 63 spans between opposing walls 66 and 67. As such, like elements between storage units 61 and lid 62 are herein identified by like reference characters.

In one example of use, vials 18 housing a vaccine are cooled to a temperature below 0° C. shortly after production. When needed, vials 18 can be transferred to a conventional cold storage container which is shipped to a location, such as a third world, where passive cold storage container system 10 is needed to house the vaccine for transport and/or storage due to a lack of reliable electricity. With reference to FIGS. 2 and 5, the cooled vials 18 are transferred from the conventional cold storage container to container system 10 by removing cap 50 and pulling out one or more storage racks 14 from storage area 37 through conduit 48. Often, storage racks 14 are merely being refurbished with vials 18 of vaccine so some storage units 61 will already house some vials 18. Those storage units 61 that lack vials 18 will be disconnected from the other storage units 61, as discussed above, and new vials 18 will be manually transferred from the conventional cold storage container to compartment 80 of the storage unit 61. Once all of storage units 61 are filled with vials 18, storage units 61 are again connected together and each storage rack 14 is then lowered back into storage area 37 of container 12 and lid 66 is replaced.

As a result of the insulative properties of container 12 and heat sink modules 16 operating as heat sinks, container 12 can be used to transport and/or store vials 18 without the need for any electricity for an extended period of up to 2-3 months without jeopardizing the integrity of the vaccine. When it is time to administer a vaccine, an operator can withdraw a single storage rack 14 from container 12, access one of the storage units 61 and withdraw one or more vials 18. The storage rack 14 with the remaining vials 18 therein can then be returned to container 12 so that vials 18 maintain their cool temperature.

Although container system 10 is highly effective for its intended purpose, it has a number of shortcomings. For example, it is critical that new vials 18 be transferred into storage units 61 and then into container 12 as quickly as possible. Delays in this process can result in gradual warming of the vaccine within the new vials 18 that are being loaded into storage units 61 and gradual warming of the vaccine within preexisting vials 18 that are in the removed storage rack 14. As previously mentioned, any warming above a predefined threshold results in deterioration and eventually inactivity of the vaccine.

In the present system, new vials 18 are manually transferred into storage units 61, i.e., each individual vial 18 is picked up by hand, either one at a time or in small handfuls, and manually placed within compartment 80 of a storage unit 61. This same manual process is also used for removing vials 18 from a storage unit 61. The manual transfer of each vial 18 separately is time consuming, thereby risking the integrity of the vaccine within all exposed vials 18, and also increasing the risk that one or more of vials 18 may be dropped or otherwise damaged during the transfer. Furthermore, the transfer of vials 18 must be done rapidly which both increases the risk for an accident and often results in vials 18 not being properly loaded within compartment 80 of a storage unit 61. Failing to stack vials 18 precisely within compartment 80 results in fewer vials 18 being held within container 12, i.e., there is lower storage capacity, and results in more vials 18 being positioned in undesirable orientations, i.e., more vials are located on their side rather than the preferred vertical orientation.

In addition, when a compartment 80 is only partially filled with vials 18, either because of improper loading or because some vials 18 have been removed for use, the remaining vials 18 are free to slide or otherwise move within compartment 80 during transport. This free sliding and movement of vials 18 can result in impacts that damage or break vials 18.

Accordingly, what is needed in the art are improvements that solve all or some of the above problems.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 1:
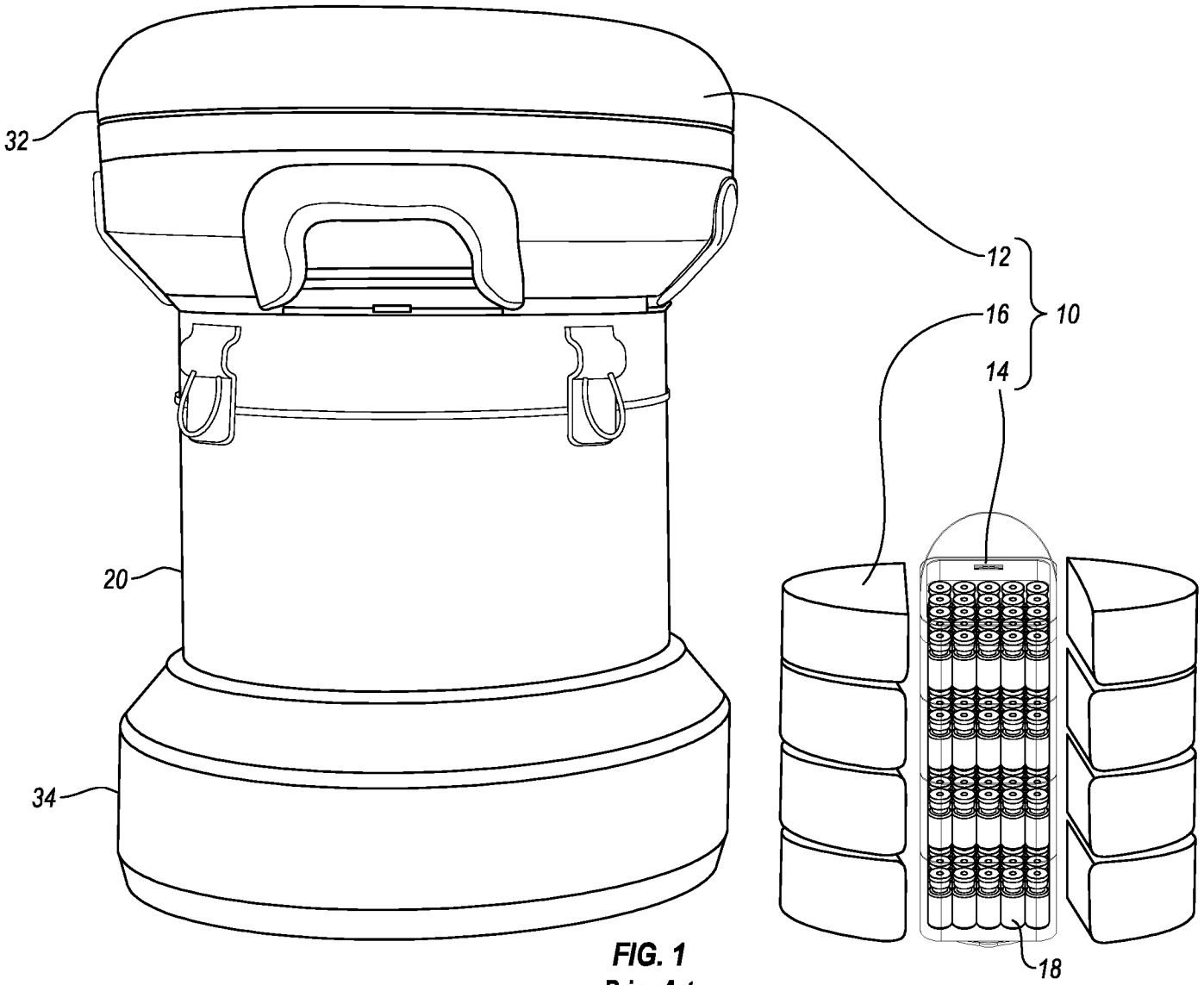
FIG. 1 Prior Art
FIG. 1 is a perspective view of a conventional passive cold storage container system.
Figure 2:
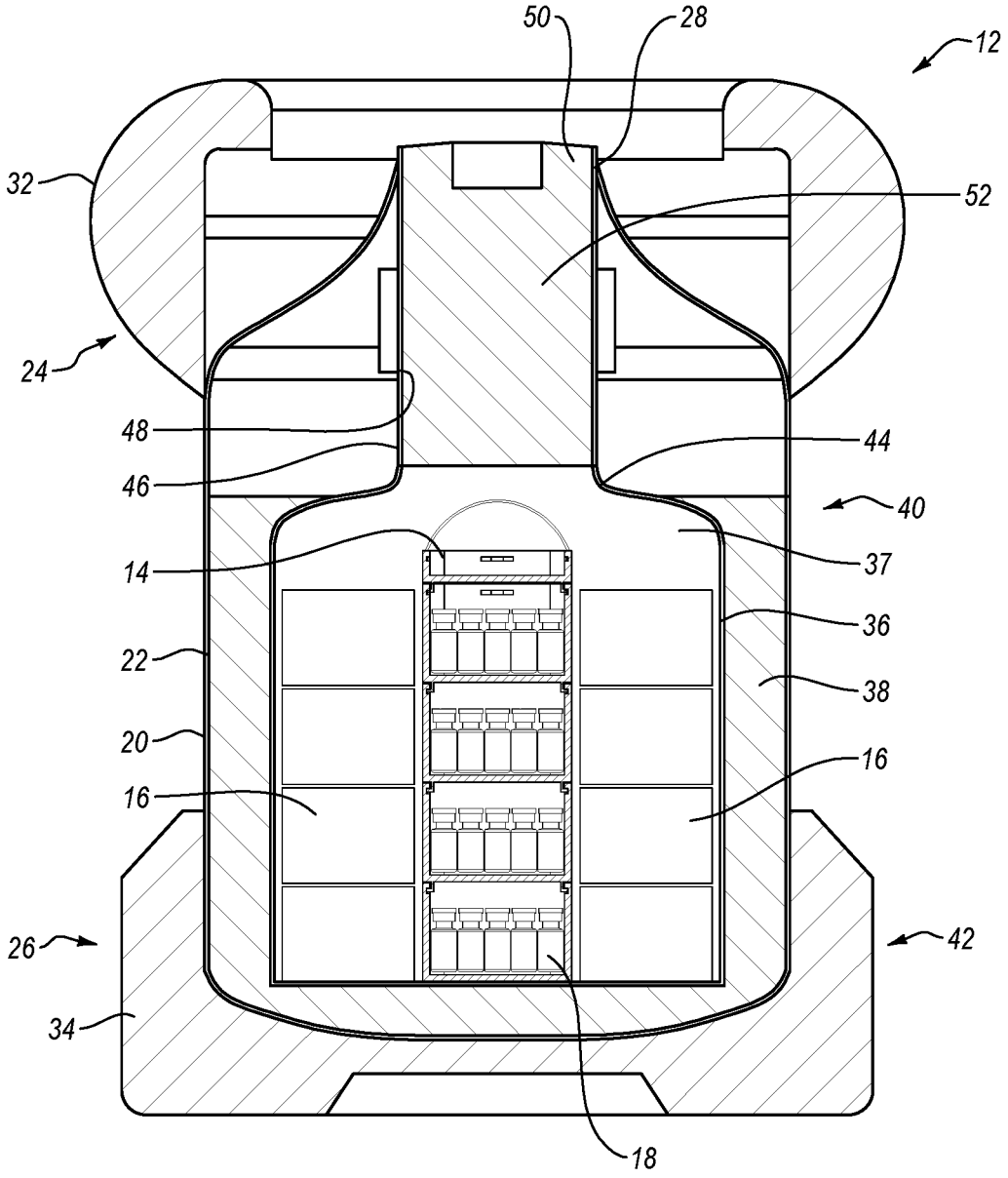
FIG. 2 Prior Art
FIG. 2 is a cross sectional side view of the assembled cold storage container system depicted in FIG. 1.
Figure 3:
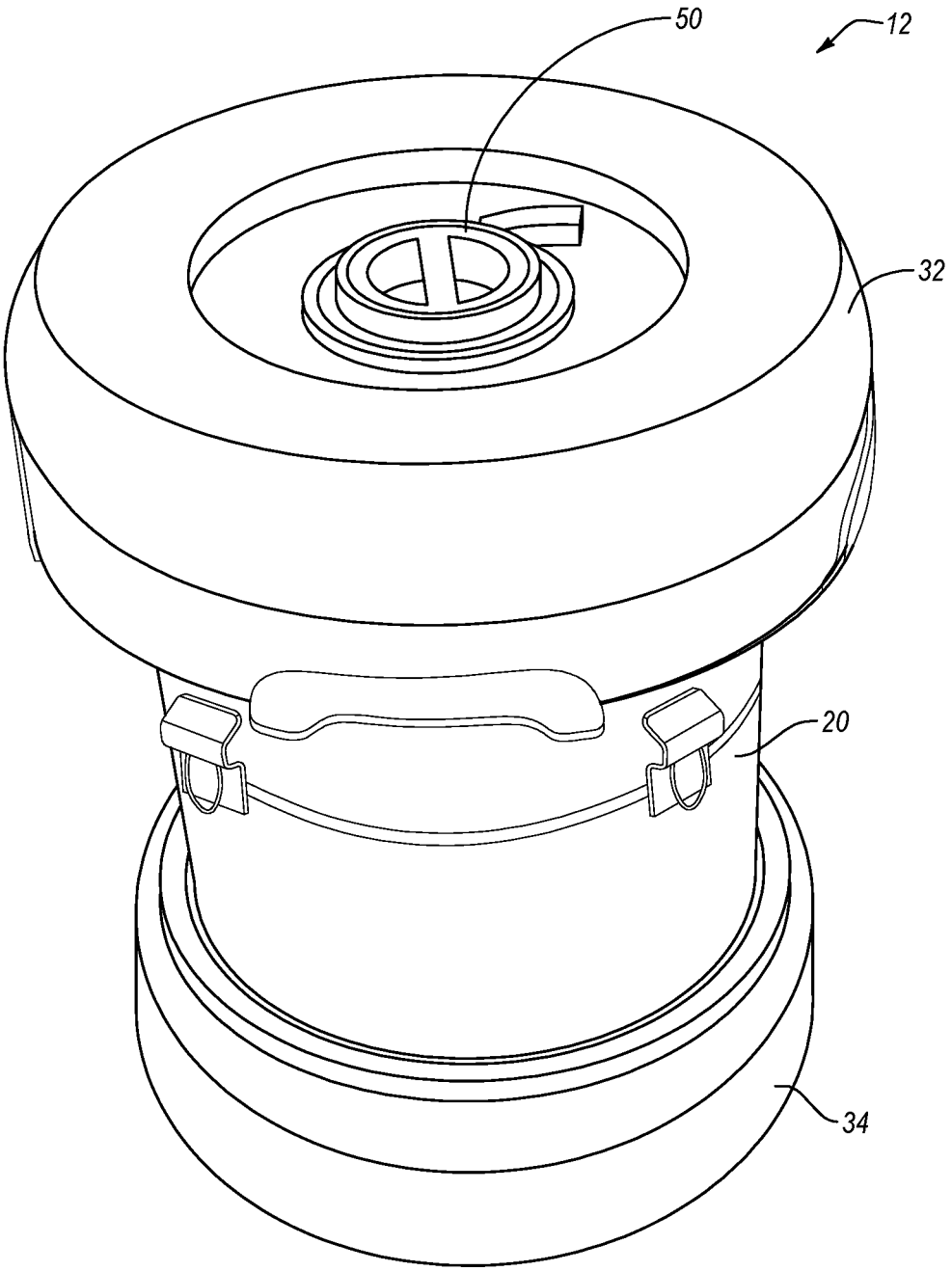
FIG. 3 Prior Art
FIG. 3 is a top perspective view of the container of the container system shown in FIG. 1.
Figure 4:
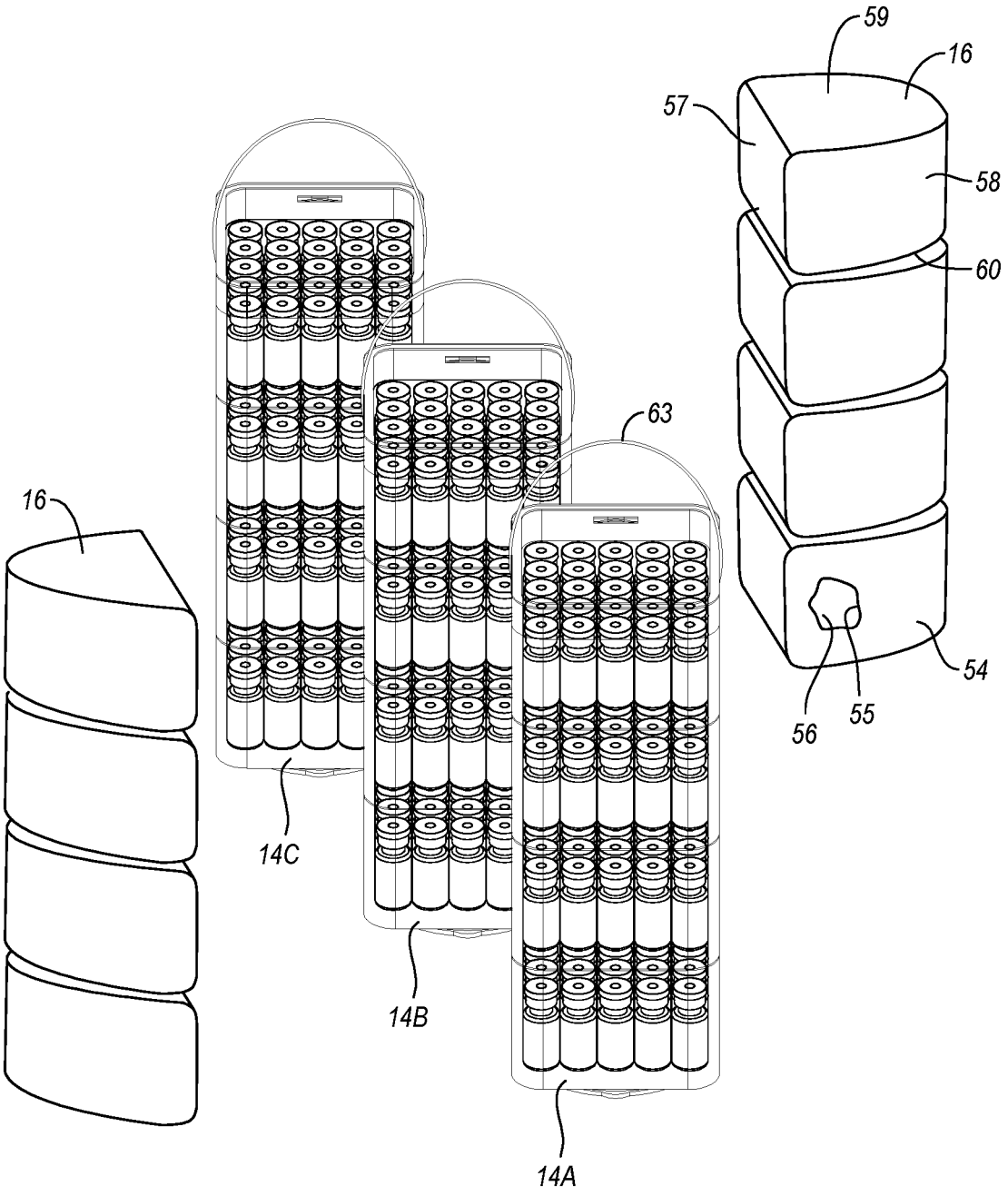
FIG. 4 Prior Art
FIG. 4 is a perspective view of the heat sink modules and storage racks of the container system shown in FIG. 1.

Before describing the present disclosure in detail, it is to be understood that this disclosure is not limited to parameters of the particularly exemplified systems, methods, apparatus, products, processes, compositions, and/or kits, which may, of course, vary. It is also to be understood that the terminology used herein is only for the purpose of describing particular embodiments of the present disclosure, and is not necessarily intended to limit the scope of the disclosure in any particular manner. Thus, while the present disclosure will be described in detail with reference to specific configurations, the descriptions are illustrative and are not to be construed as limiting the scope of the claimed invention. Various modifications can be made to the illustrated configurations without departing from the spirit and scope of the invention as defined by the claims. Thus, while various aspects and embodiments have been disclosed herein, other aspects and embodiments are contemplated.

Unless defined otherwise, all technical and scientific terms used herein have the same meaning as commonly understood by one of ordinary skill in the art to which the present disclosure pertains. While a number of methods and materials similar or equivalent to those described herein can be used in the practice of the present disclosure, only certain exemplary materials and methods are described herein.

Various aspects of the present disclosure, including devices, systems, methods, etc., may be illustrated with reference to one or more exemplary embodiments or implementations. As used herein, the terms "alternative embodiment" and/or "exemplary implementation" means "serving as an example, instance, or illustration," and should not necessarily be construed as preferred or advantageous over other embodiments or implementations disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

It will be noted that, as used in this specification and the appended claims, the singular forms "a," "an" and "the" include plural referents unless the content clearly dictates otherwise. Thus, for example, reference to a "panel" includes one, two, or more panels. Similarly, reference to a plurality of referents should be interpreted as comprising a single referent and/or a plurality of referents unless the content and/or context clearly dictate otherwise. Thus, reference to "panels" does not necessarily require a plurality of such panels. Instead, it will be appreciated that independent of conjugation; one or more panels are contemplated herein.

As used throughout this application the words "can" and "may" are used in a permissive sense (i.e., meaning having the potential to), rather than the mandatory sense (i.e., meaning must). Additionally, the terms "including," "having," "involving," "containing," "characterized by," variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

Various aspects of the present disclosure can be illustrated by describing components that are coupled, attached, connected, and/or joined together. As used herein, the terms "coupled", "attached", "connected," and/or "joined" are used to indicate either a direct connection between two components or, where appropriate, an indirect connection to one another through intervening or intermediate components. In contrast, when a component is referred to as being "directly coupled", "directly attached", "directly connected," and/or "directly joined" to another component, no intervening elements are present or contemplated. Thus, as used herein, the terms "connection," "connected," and the like do not necessarily imply direct contact between the two or more elements. In addition, components that are coupled, attached, connected, and/or joined together are not necessarily (reversibly or permanently) secured to one another. For instance, coupling, attaching, connecting, and/or joining can comprise placing, positioning, and/or disposing the components together or otherwise adjacent in some implementations.

As used herein, directional and/or arbitrary terms, such as "top," "bottom," "front," "back," "left," "right," "up," "down," "upper," "lower," "inner," "outer," "internal," "external," "interior," "exterior," "proximal," "distal" and the like can be used solely to indicate relative directions and/or orientations and may not otherwise be intended to limit the scope of the disclosure, including the specification, invention, and/or claims.

Where possible, like numbering of elements have been used in various figures. Furthermore, alternative configurations of a particular element may each include separate letters appended to the element number. Accordingly, an appended letter can be used to designate an alternative design, structure, function, implementation, and/or embodiment of an element or feature without an appended letter. Similarly, multiple instances of an element and or sub-elements of a parent element may each include separate letters appended to the element number. In each case, the element label may be used without an appended letter to generally refer to instances of the element or any one of the alternative elements. Element labels including an appended letter can be used to refer to a specific instance of the element or to distinguish or draw attention to multiple uses of the element. However, element labels including an appended letter are not meant to be limited to the specific and/or particular embodiment(s) in which they are illustrated. In other words, reference to a specific feature in relation to one embodiment should not be construed as being limited to applications only within said embodiment.

It will also be appreciated that where a range of values (e.g., less than, greater than, at least, and/or up to a certain value, and/or between two recited values) is disclosed or recited, any specific value or range of values falling within the disclosed range of values is likewise disclosed and contemplated herein. Thus, disclosure of an illustrative measurement or distance less than or equal to about 10 units or between 0 and 10 units includes, illustratively, a specific disclosure of: (i) a measurement of 9 units, 5 units, 1 units, or any other value between 0 and 10 units, including 0 units and/or 10 units; and/or (ii) a measurement between 9 units and 1 units, between 8 units and 2 units, between 6 units and 4 units, and/or any other range of values between 0 and 10 units.

It is also noted that systems, methods, apparatus, devices, products, processes, compositions, and/or kits, etc., according to certain embodiments of the present invention may include, incorporate, or otherwise comprise properties, features, components, members, and/or elements described in other embodiments disclosed and/or described herein. Thus, reference to a specific feature in relation to one embodiment should not be construed as being limited to applications only within said embodiment.

The headings used herein are for organizational purposes only and are not meant to be used to limit the scope of the description or the claims. To facilitate understanding, like reference numerals have been used, where possible, to designate like elements common to the figures.

Figure 8:
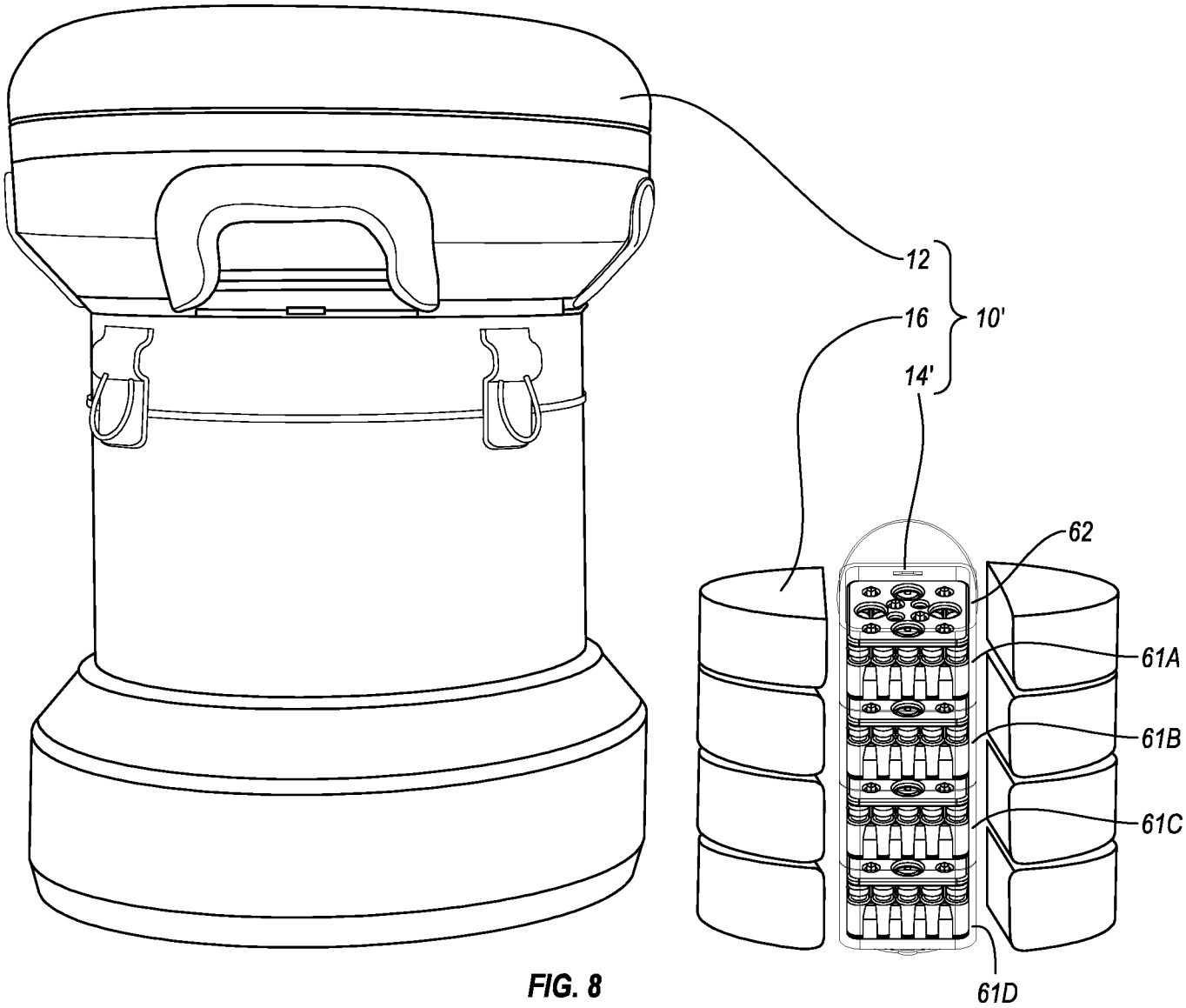
FIG. 8 is a perspective view of a passive cold storage container system incorporating features of the present invention.

In general, the present disclosure is directed to packaging trays and retention plates that can be used with passive cold storage container systems, such as that previously discussed in the background section, for use in loading and retaining medicinal carriers, such as vials 18, and to cold storage container systems incorporating such trays and/or retention plates. Depicted in FIG. 8 is one embodiment of an inventive passive cold storage container systems 10' incorporating features of the present invention. In general, container systems 10' includes all of container system 10, previously discussed, with the addition of one or more packaging trays and/or retention plates for use in loading and retaining medicinal carriers. As such, like elements between container systems 10' and container system 10 are identified by like reference characters and all of the prior disclosure of container system 10 is hereby incorporated into this disclosure of the preferred embodiments of the present invention.

Container system 10' includes container 12, a plurality of storage racks 14' and a plurality of heat sink modules 16. Container 12 and heat sink modules 16 can have the same design, compositions, operation and alternatives as that previously discussed herein. However, they are not necessarily limited to the prior discussed designs. Further specifics and alternatives for container 12 and heat sink modules 16, including specifics and alternatives for design, compositions, and operation, are disclosed in U.S. Patent Publication No. 2011/0127273, published Jun. 2, 2011; U.S. Patent Publication No. 2011/0155745, published Jun. 30, 2011; U.S. Patent Publication No. 2014/0150464, published Jun. 5, 2014; and U.S. Patent Publication No. 2014/0352329, published Dec. 4, 2014, which are incorporated herein in their entirety by specific reference. During use in the present invention, container 12 can be used to hold a medicinal preparation cold at a temperature less than 0° C., −10° C., −20° C., −40° C., −60° C., or −80° C. for extended periods of time such as at least 1, 2, 4, 6, 8, 10, or 12 weeks without the use of electricity.

Figure 5:
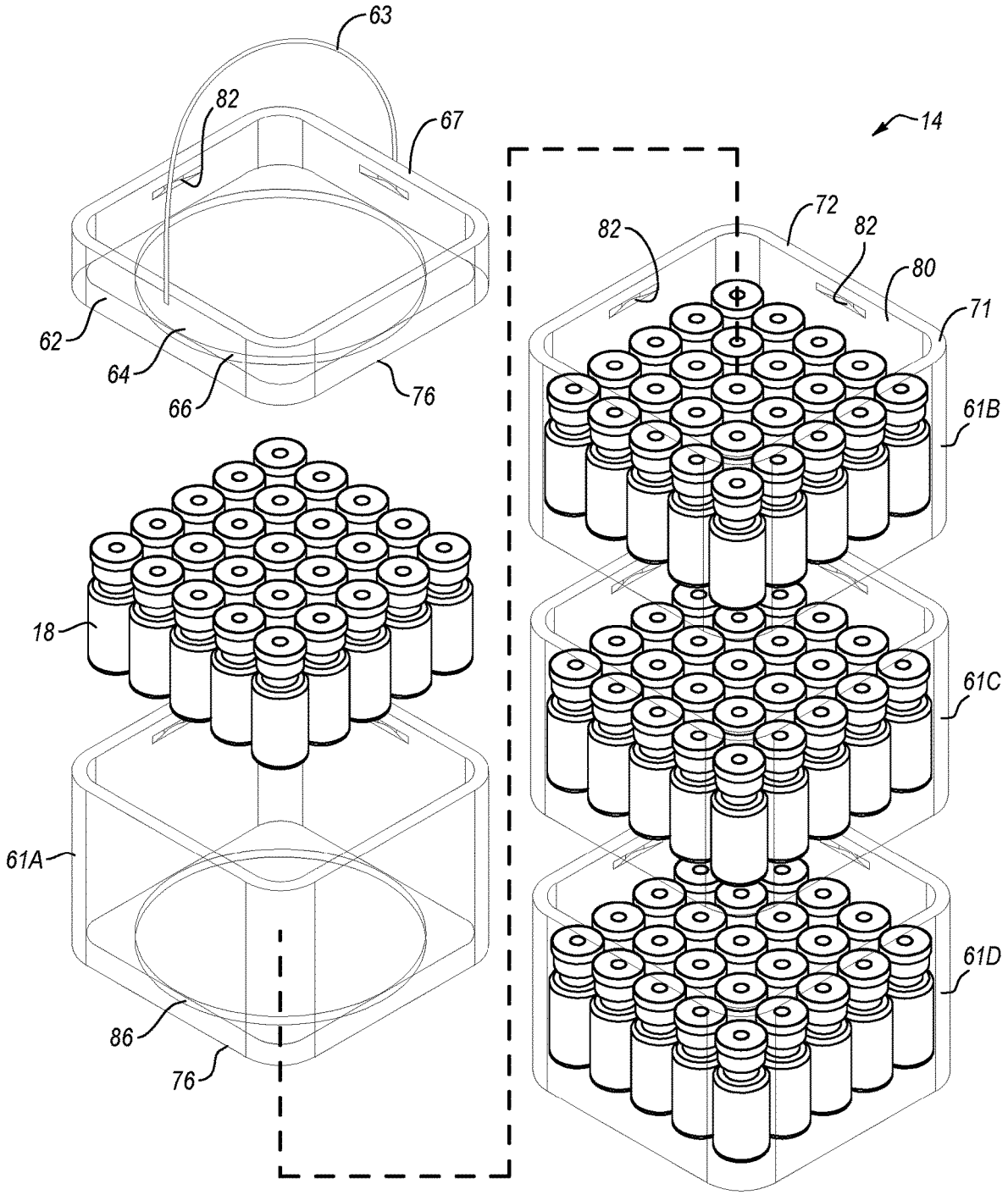
FIG. 5 Prior Art
FIG. 5 is a partially exploded view of one of the storage racks shown in FIG. 4 having vials disposed therein.
Figure 6:
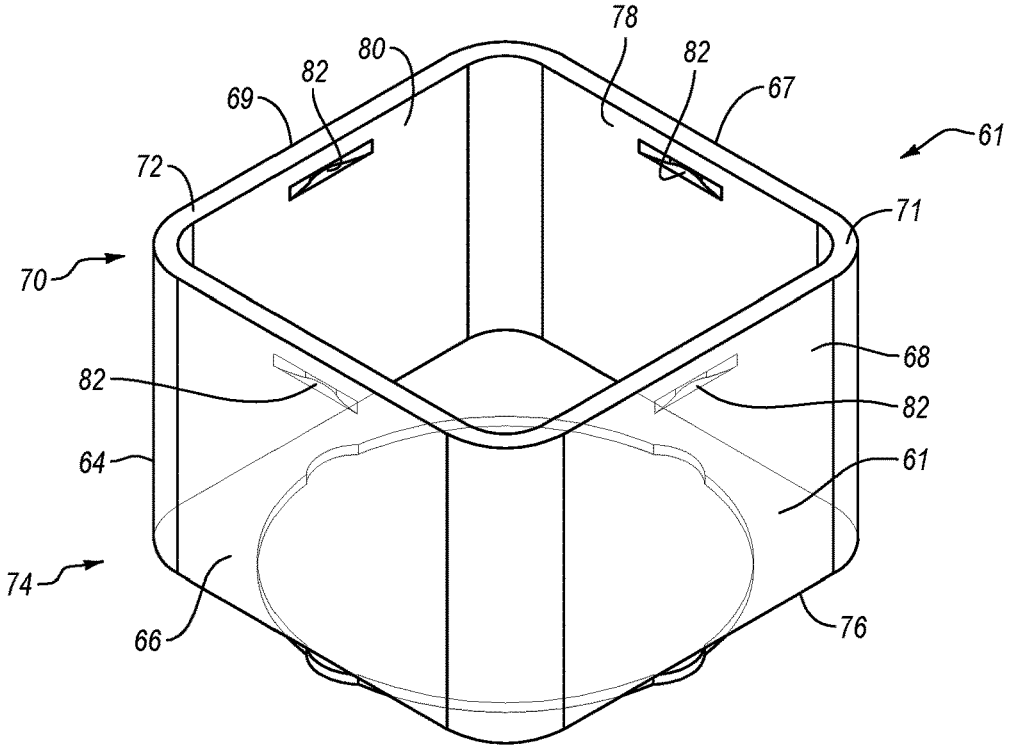
FIG. 6 Prior Art
FIG. 6 is a top perspective view of one of the storage units of the storage rack shown in FIG. 5.
Figure 7:
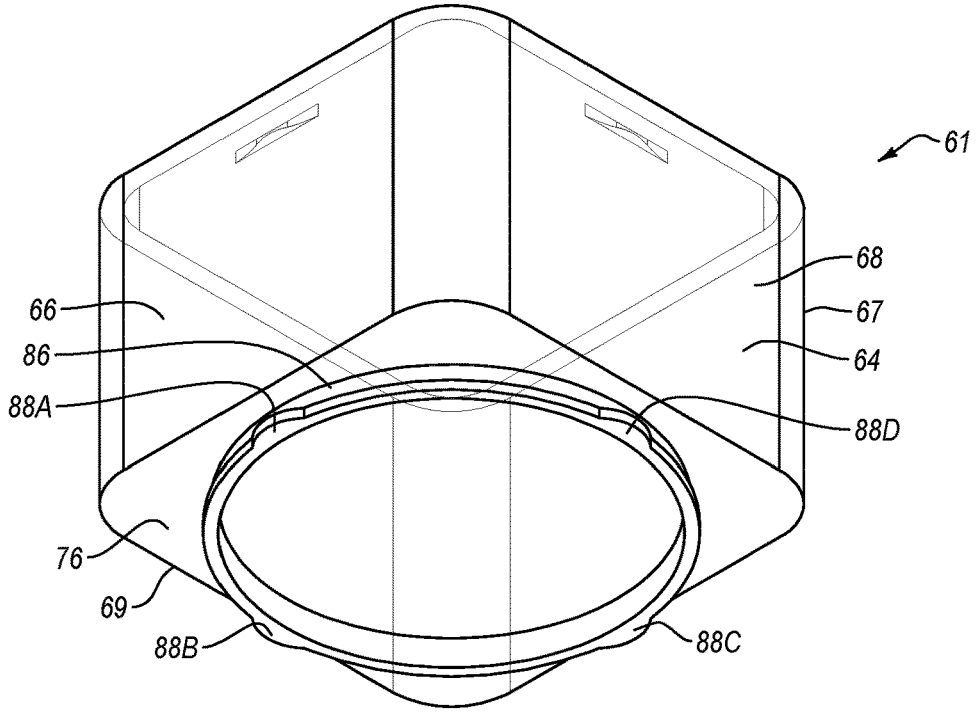
FIG. 7 Prior Art
FIG. 7 is a bottom perspective view of the storage unit shown in FIG. 6.

Storage rack 14' includes lid 62 and storage units 61A-61D having the same design, composition, operation, interlocking, and alternatives as previously discussed. It is further noted, however, that each storage unit 61 need not have a substantially square transverse cross section but could be round, oval, or have other polygonal or irregular configurations. Likewise, heat sink modules 16 can have different contours to complementary fit against alternative designs for storage units 61. In addition, although storage rack 14' is shown having four storage units 61, in alternative designs storage rack 14' can be limited to one, two, three, or five or more storage units 61 in a single storage rack 14'. In addition, storage units 61 can be different heights. For example, where medicinal carriers, i.e., the containers that hold the vaccine or other medicinal preparations, are taller relative to vials 18 depicted in FIG. 5, a storage rack 14' may only have two or three stacked storage units 61 but with the storage units 61 being taller relative to those preparation may be in the form of a liquid, gel, solid, semi-solid, vapor, or gas. In some depicted in FIG. 5. For a given storage rack 14', however, it can be desirable to have each storage unit 61 have an identical configuration. This enables storage units to be reordered and interlocked without any complications.

In another alternative, it is appreciated that alternative means for releasably interlocking stacked storage units 61 together can be used. For example, interlocking tabs 88 and engagement notches 82 can be replaced with bayonet connections, tongue and groove connections, clamps, fasteners, straps, or the like. Storage units 61 are typically formed from a transparent plastic to enable an operator to see where and how many medicinal carriers 18' are being stored. However, other plastics and materials can also be used.

Figure 9:
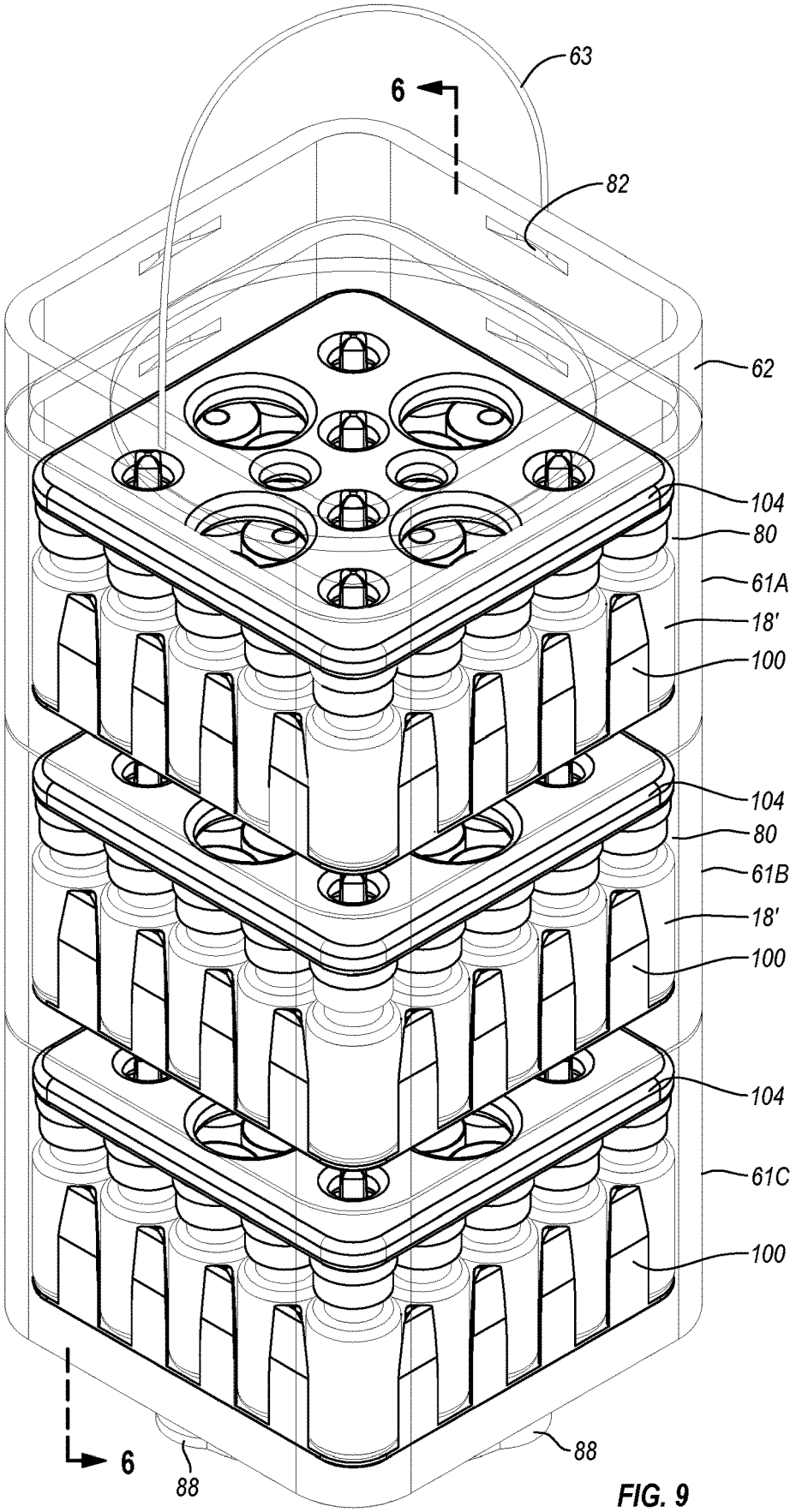
FIG. 9 is a perspective view of one of the storage racks of the container system shown in FIG. 8.
Figure 10:
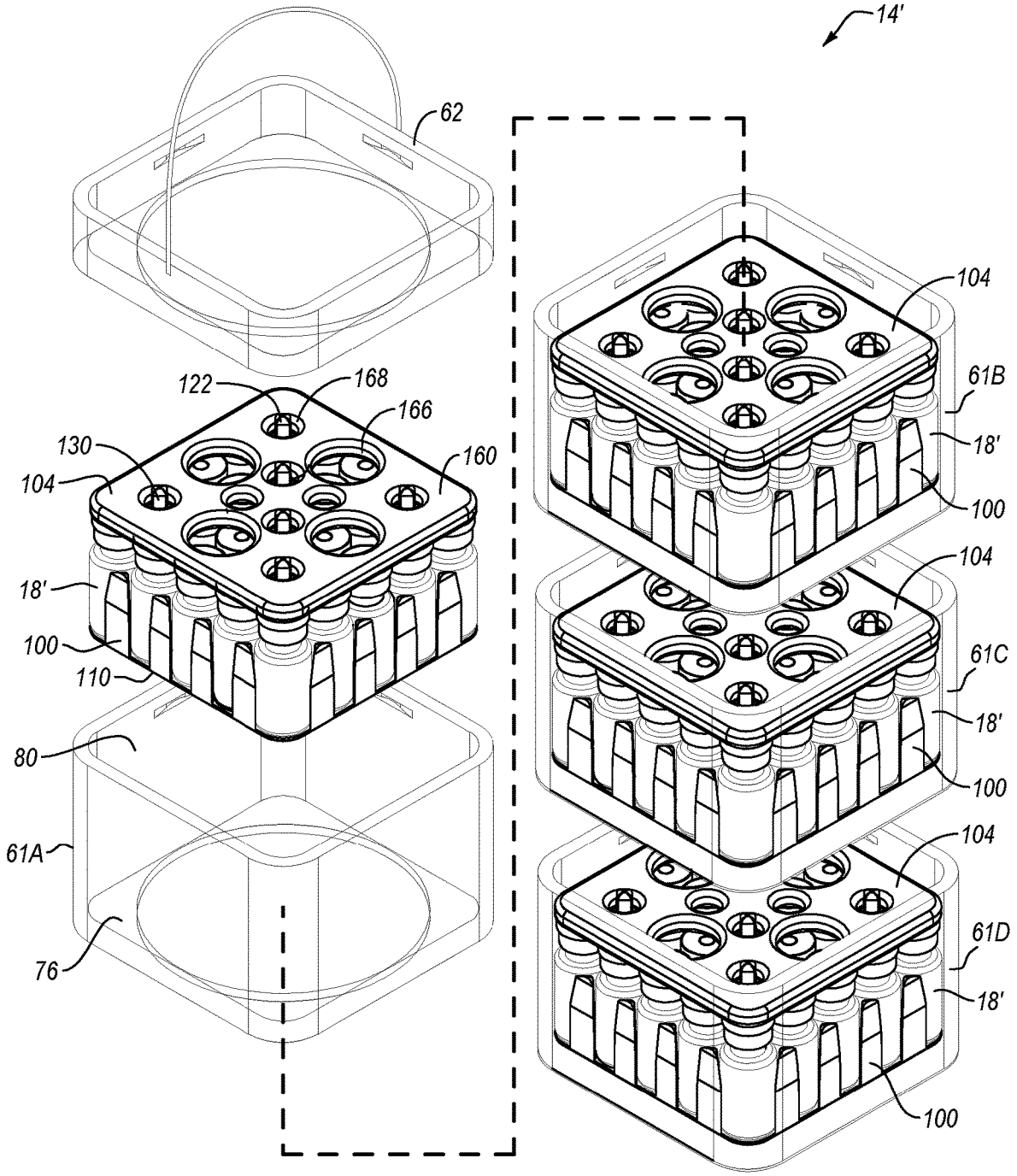
FIG. 10 is a partially exploded view of the storage rack shown in FIG. 9.

As depicted in FIGS. 9 and 10, at least partially disposed within each storage unit 61 is a tray 100, a retention plate 104 and a plurality of medicinal carriers 18'. Medicinal carriers 18' are used to hold a medicinal preparation. The term "medicinal preparation", as used herein, can include a drug, composition, formulation, material or compound intended for medicinal or therapeutic use. For example, a medicinal preparation may include drugs, vaccines, therapeutics, vitamins, pharmaceuticals, remedies, homeopathic agents, naturopathic agents, or treatment modalities in any form, combination or configuration. Examples of treatment modalities can include antibody therapies, small-molecule compounds, anti-inflammatory agents, therapeutic drugs, vitamins, or pharmaceuticals in any form, combination or configuration. A medicinal preparation may be in the form of a liquid, gel, solid, semi-solid, vapor, or gas. In some embodiments, a medicinal preparation may be a composite. For example, a medicinal preparation may include a bandage infused with antibiotics, anti-inflammatory agents, coagulants, neurotrophic agents, angiogenic agents, vitamins or pharmaceutical agents.

Depending on the form of the medicinal preparation and the quantity to be dispensed, medicinal carrier 18' can also come in a variety of different configurations and sizes. For example, medicinal carrier 18' can comprise a vial, such as vial 18, ampule, syringe, pill bottle, bottle for holding liquids, canister for holding a pressurized gas, sterile packaging, wrappers, and other types of containers.

Figure 11:
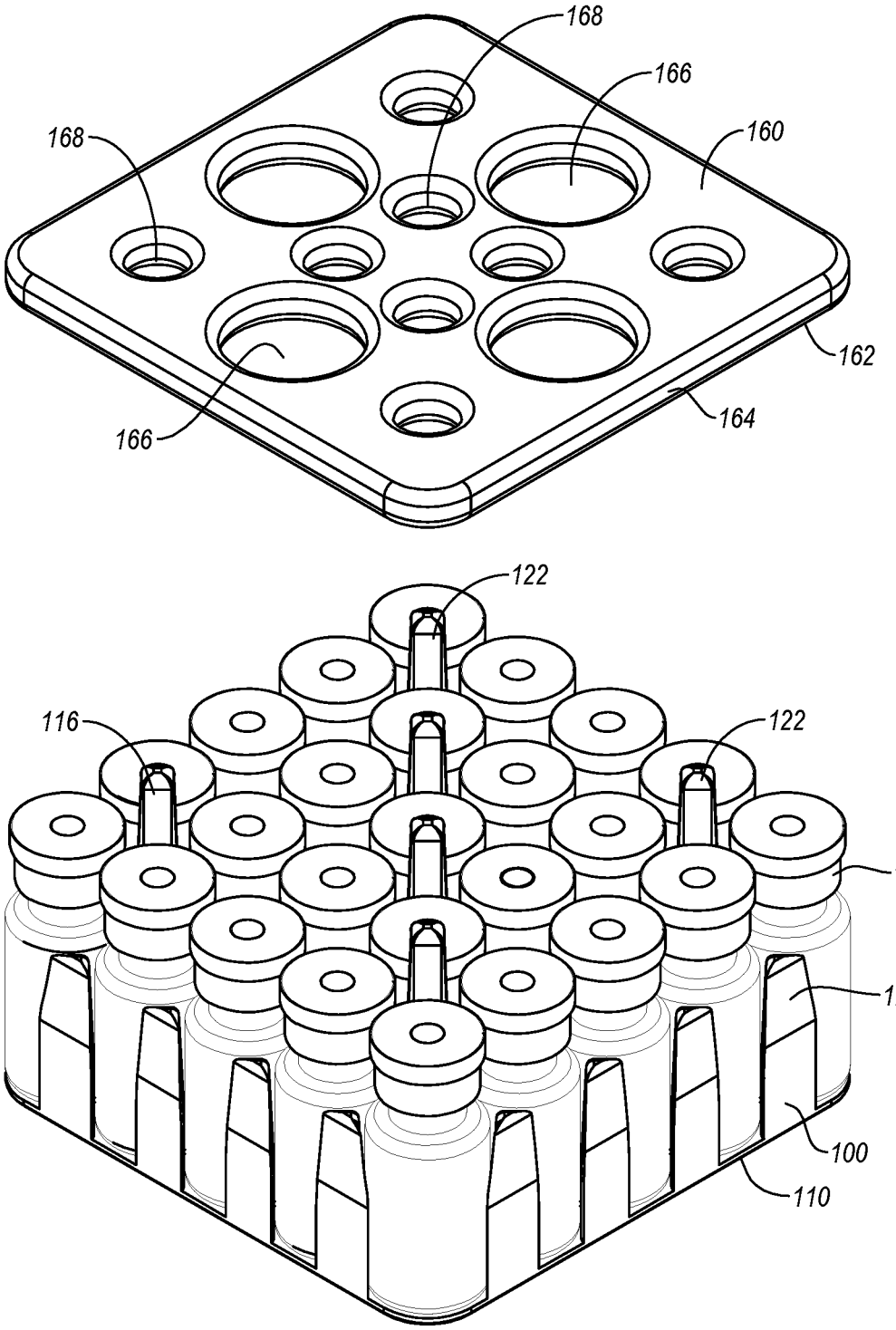
FIG. 11 is a perspective view of the tray housing medicinal carriers and the retention plate shown in FIG. 10.
Figure 12:
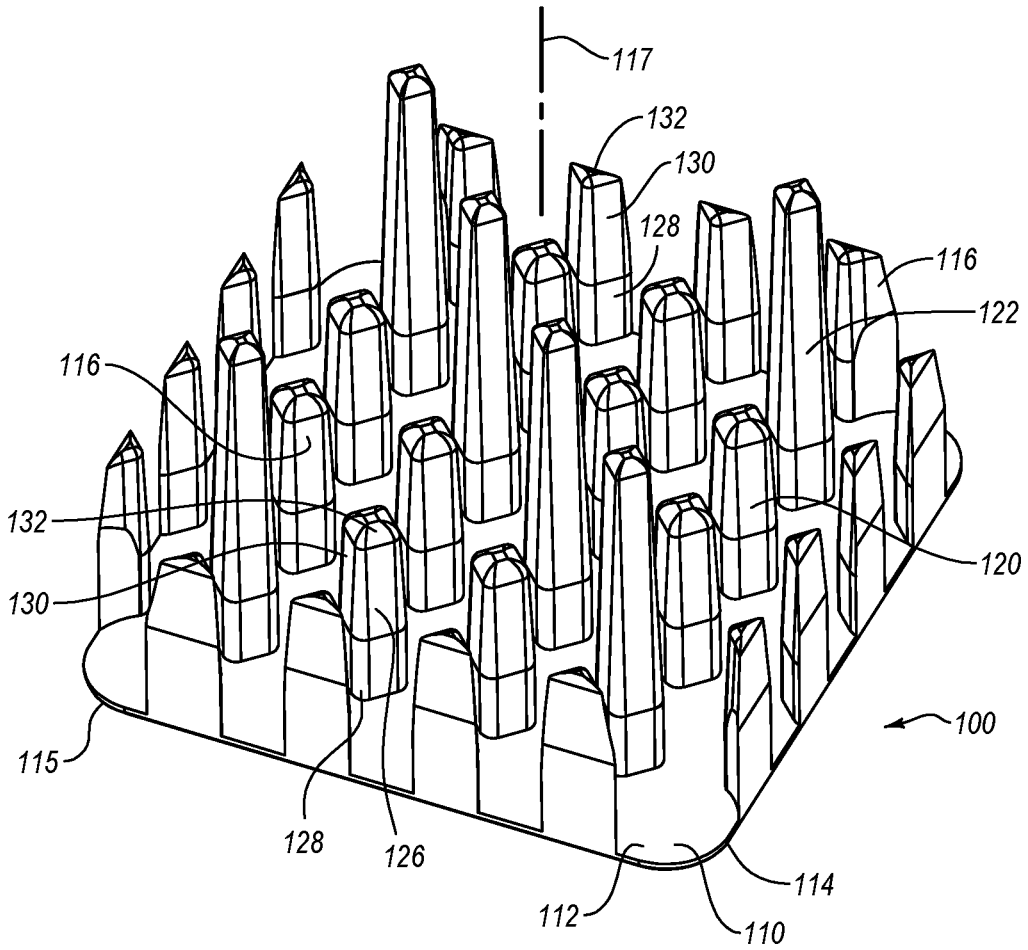
FIG. 12 is a top perspective view of the tray shown in FIG. 11.

Each tray 100 is configured to be removably received within compartment 80 of a storage unit 61 and is configured to receive and retain a plurality of medicinal carriers 18'. As depicted in FIGS. 11 and 12, tray 100 comprises a floor 110 having a top surface 112 and an opposing bottom surface 114 that extend to a perimeter edge 115. Perimeter edge 115 of floor 110 is typically complementary to the interior perimeter of compartment 80 (FIG. 10) but sized so that tray 100 can be freely received within compartment 80 so as to rest on bottom wall 76. In the depicted embodiment, floor 110 is a substantially planer structure having a square or rectangular configuration with rounded corners 111. Other configurations can also be used to match alternative configurations for storage units 61. For example, floor could be circular, oval, triangular, polygonal or have other configuration. In one embodiment, floor 110 has a maximum dimension, which could be a width, length, diameter etc., that is greater than, smaller than, equal to, or in a range between any two of 8 cm, 12 cm 16 cm, 20 cm, 24 cm, or 28 cm.

Tray 100 further comprises a plurality of spacers 116 upstanding from top surface 112 of floor 110. Each spacer 116 typically has a central longitudinal axis 117 that is perpendicular to top surface 112 of floor 110. Spacers 116 include primary spacers 120 and engagement spacers 122 with engagement spacers 122 being longer than primary spacer 120.

Figure 13:
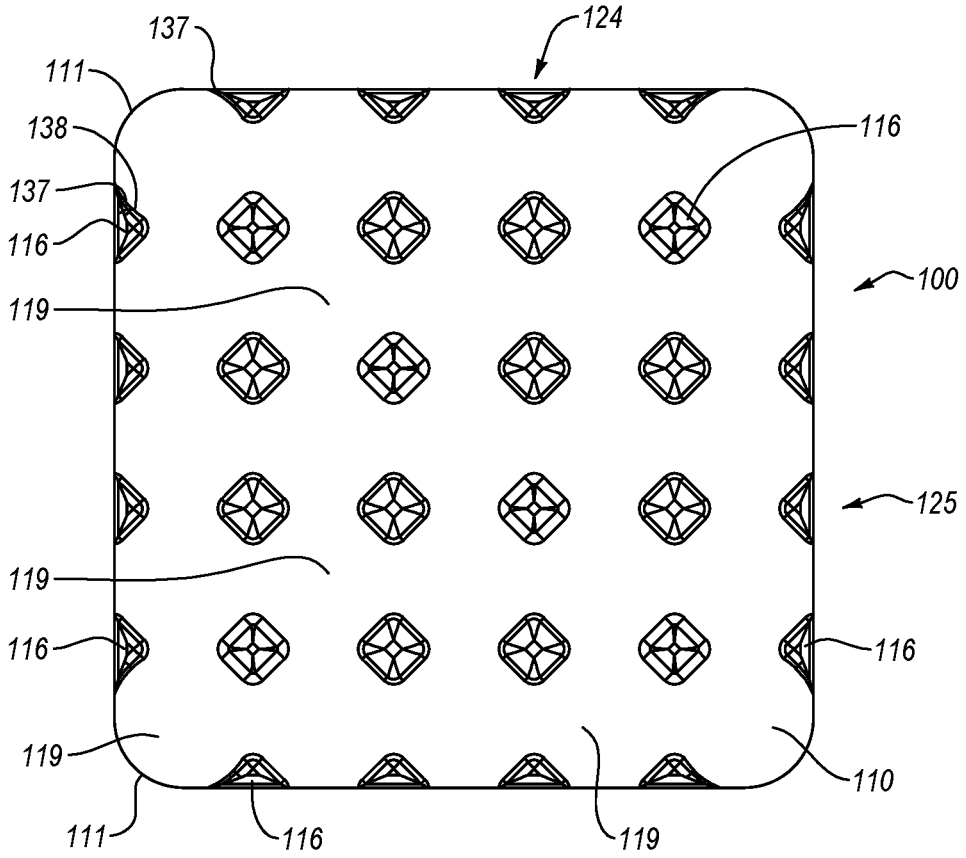
FIG. 13 is a top plan view of the tray shown in FIG. 12.

As depicted in FIG. 13, spacers 116 are spaced apart and orientated in linear columns 124 and rows 125 so that spacers 116 partially bound a plurality of retention slots 119. Each retention slot 119 is bounded by four spaced apart spacers 116 and is configured to receive a single medicinal carrier 18' therein. One exception is the four corners where retention slots 119 are formed that are only bounded by three spacers 116. In the depicted embodiment, six columns 124 and six rows 125 are formed so as to produce twenty five retention slots 119. In other embodiments, such as where tray 100 is larger or smaller or where medicinal carriers 18' are larger or smaller, any desired number of columns 124, rows 125, and retention slots 119 can be formed. For example, the number of columns 124 and rows 125 can each be greater than, smaller than, equal to, or in a range between any two of 3, 5, 7, 9, 13, 15, 17, or 20. The numbers of rows and columns can either be the same or different. The total number of spacers can be greater than, smaller than, equal to, or in a range between any two of 6, 10, 16, 24, 30, 40, 50, 60 or 70. The number of primary spacers 120 can be at least 2, 3, 4, 5, or 6 times the number of engagement spacers 122. The length of primary spacers 120 can be greater than, smaller than, equal to, or in a range between any two of 1 cm, 3 cm, 5 cm 7 cm 9 cm, or 11 cm. Engagement spacers 122 can be longer than primary spacers 120 by at least 1 cm, 2 cm, 3 cm 4 cm, 5 cm, 6 cm or 7 cm. The number of retention slots 119 can be greater than, smaller than, equal to, or in a range between any two of 5, 10, 15, 20, 25, 30, 35, 40, 45, 50, or 60.

Spacers 116 are configured so that when a medicinal carrier 18' is positioned within a retention slot 119, the medicinal carrier 18' is bounded on three or four radially spaced apart sides so as to be laterally captured or restrained within retention slot 119. Spacers 116 can either directly bias against medicinal carrier 18' or can be slightly spaced apart. In either design, spacers 116 preclude the medicinal carrier 18' from laterally sliding out of the retention slot 119 and typically limit any lateral linear movement to less than 10 mm, 6 mm 4 mm, 2 mm or 1 mm.

Returning to FIG. 12, each spacer 116 has an encircling side wall 126 that extends from a lower end 128, which is secured to floor 110, to an upper end 130. Upper end 130 terminates at a rounded nose 132. Spacer 116 that are inwardly disposed from perimeter edge 115 of floor 110 each have a substantially square transverse cross section with rounded corners. Each face of encircling side wall 126 faces toward a corresponding retention slot 119. In one embodiment, encircling side wall 126 has a lower portion 134 wherein encircling side wall 126 is vertically disposed and an upper portion 136 that inwardly tapers to rounded nose 132. Rounded nose 132 and the tapering of upper portion 136 facilitates guiding of medicinal carriers 18' into retention slots 119 while the vertical sides of lower portion 134 help to limit any lateral sliding or tipping of medicinal carriers 18' received within retention slots 119.

In contrast to the above, spacers 116 disposed on perimeter edge 115 of floor 110 have a substantially triangular transverse cross section. Again, these perimeter spacers 116 have an upper portion 130 that inwardly tapers to a rounded nose 132 and a lower portion 128 that is substantially vertical. Although most spacers 116 are symmetrical, it is noted that the perimeter spacers 116 adjacent to each corner 111 of floor 110 are asymmetrical. Specifically, as shown in FIG. 13, a corner 137 of each spacer 116 that faces toward corner 111 has a concave surface 138 and is lengthened to project more toward corner 111. This lengthened corner 137 compensates for the loss of the forth spacer 116 at corner 111 and helps to secure medicinal carrier 18' positioned in retention slot 119 at corner 111.

Returning to FIG. 12, it is appreciated that spacers 116 can have a variety of different configurations. For example, spacers 116 need not have upper portion 136 that inwardly tapers. Rather, encircling side wall 126 could extend vertically along the entire length thereof. Or, alternatively, encircling side wall 126 could taper along the entire length of lower portion 134 and upper portion 136. In still other embodiments, spacers 116 need not have a substantially square transverse cross section but could be circular, oval, polygonal or have a plurality of discrete outwardly bulging surfaces or inwardly concave surfaces or combinations of the foregoing. Other configurations can also be used. As previously mentioned, spacers 116 are designed to securely retain medicinal carriers 18'. To that end, encircling side wall 126 can change based on the configuration of medicinal carriers 18'. That is, portions of side wall 126 can be configured to complementary mate or otherwise support medicinal carriers 18'. In other embodiments, it is also appreciated that spacers 116 need not be disposed in linear rows and columns but could be otherwise spaced to still form retention slots 119. In still other embodiments, top surface 112 of floor 110 on which medicinal carriers 18' rest need not be flat but could be contoured such as by having recessed pockets, bulges, projections or other structures at each retention slot 119 or between each retention slot to better receive or retain medicinal carriers 18'. Tray 100 is typically formed from a plastic but could also be made from fiberglass, a composite, or other materials.

Figure 14:
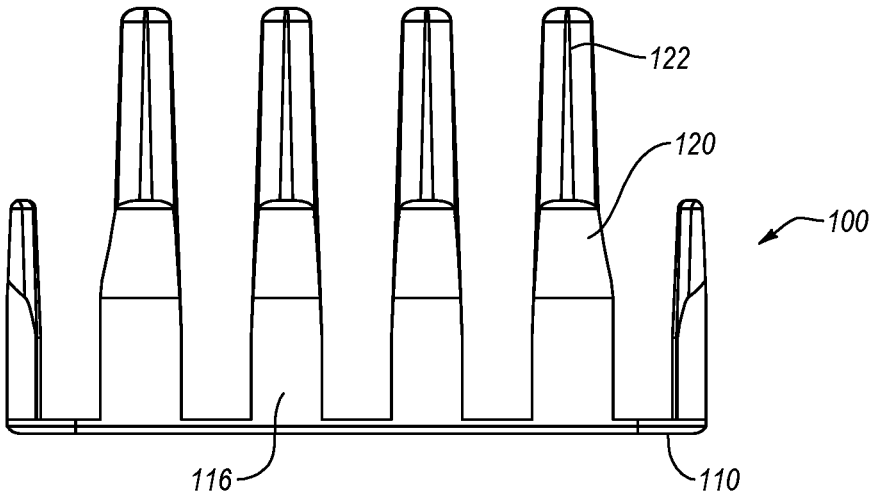
FIG. 14 is an elevated side view of the tray shown in FIG. 13.

As previously mentioned and depicted in FIGS. 11 and 14, engagement spacers 122 project at a height above floor 110 that is greater than the height of primary spacers 122. In the embodiment depicted in FIG. 11, medicinal carriers 18' have a height extending along the length thereof that is greater than the height of primary spacers 120 but shorter than the height of engagement spacers 122. This configuration is beneficial in that because engagement spacers 122 project above medicinal carriers 18', engagement spacers 122 can be used as handles to manually grab tray 100 and place it within compartment 80 of storage unit 61. That is, an operator can manually grasp exposed upper ends 130 of one, two or more of engagement spacers 122 to securely pick up tray 100 and place it within compartment 80 of storage unit 61. Engagement spacers 122 can also be used as handles to remove tray 100 from compartment 80 of a storage unit 61. Alternative embodiments of trays 100 that can be used in the present invention are disclosed in U.S. Design application No. 29/520,442, filed Mar. 13, 2015 which is incorporated herein by specific reference.

During use, medicinal carriers 18' can be loaded onto trays 100 under controlled environmental conditions, such as directly after production of the medicinal preparation or prior to transporting to container system 10'. When it is time to load medicinal carriers 18' into container system 10', one or more storage racks 14 are removed from container 12, and storage units 16 are separated. Each tray 100 that is housing medicinal carriers 18' can then be manually removed from the conventional cold storage container, freezer, or other holding container, such as by grasping engagement spacers 122, and then deposited into compartment 80 of a corresponding storage unit 16. Storage units 16 are then reassembled into storage rack 14 and placed back within container 12. Trays 100 can also be used to simultaneously remove a plurality of medicinal carriers 18' from a storage unit 16.

The use of tray 100 achieves a number of benefits. For example, tray 100 is designed to maximize the number of medicinal carriers 18' that can be packed into compartment 80 of each storage unit 61. Thus, by using tray 100 with each storage unit 61, the load capacity of container 12 is optimized. Furthermore, tray 100 individually supports each medicinal carrier 18'. Thus, even when a compartment 80 of a storage unit 61 is only partially filled with medicinal carriers 18', tray 100 prevents the remaining medicinal carriers 18' from laterally sliding around and potentially being damaged or broken. In addition, tray 100 that is housing medicinal carriers 18' can be easily and safely lifted to simultaneously transfer a full load of medicinal carriers 18' into compartment 80 of a storage unit 61. This movement enables medicinal carriers 18' to be more quickly transferred into a container 12 so that there is less risk of warming and deterioration of the exposed medicinal preparation. Likewise, using tray 100 requires fewer individual movements of the medicinal carriers 18', thereby decreasing the risk that some may be dropped or damaged.

As depicted in FIGS. 9 and 10, retention plate 104 can be disposed over tray 100 and medicinal carriers 18' and be received within compartment 80 of a storage unit 61. As shown in FIG. 11, retention plate 104 comprises a top surface 160 and an opposing bottom surface 162 that are typically disposed in parallel alignment and that extend to and encircling perimeter edge 164. Perimeter edge 164 is typically complementary to the interior perimeter of compartment 80 (FIG. 10) of storage unit 61 but sized so that retention plate 104 can be freely received within compartment 80. Thus, in some embodiments perimeter edge 164 can have the same perimeter configuration as floor 110 of tray 100. Retention plate 104 can also have the same alternative configurations as previously discussed above with regard to floor 110.

Extending through retention plate 104 between surfaces 162 and 164 are a plurality of larger handle openings 166 and a plurality of smaller pass-through openings 168. Handle openings 166 enable a user to easily grasp retention plate 104 for select movement. Pass-through openings 168 are sized and positioned so that when retention plate 104 is position over and rested on top of medicinal carriers 18', as depicted in FIG. 10, engagement spacers 122 project through correspondence pass-through openings 168 and extend above top surface 160. In one embodiment, engagement spacers 122 project sufficiently far above retention plate 104 that upper ends 130 of engagement spacers 122 can be manually grasped to facilitate lifting tray 100 and medicinal carriers 18' as discussed above. Thus, even when retention plate 104 is positioned over medicinal carriers 18', engagement spacers 122 can be used for manually placing tray 100 into a storage unit 61 or removing tray 100 from a storage unit 61. In one embodiment, engagement spacers 122 project above top surface 160 of retention plate 104 by an amount greater than, less than, or equal to 5 mm, 10 mm, 15 mm or 20 mm. In other embodiments, such as discussed below, engagement spacers 122 may not extend through pass-through openings 168 or even project into pass-through openings 168. In those embodiments, retention plate 104 may need to be moved separate from tray 100.

Figure 15:
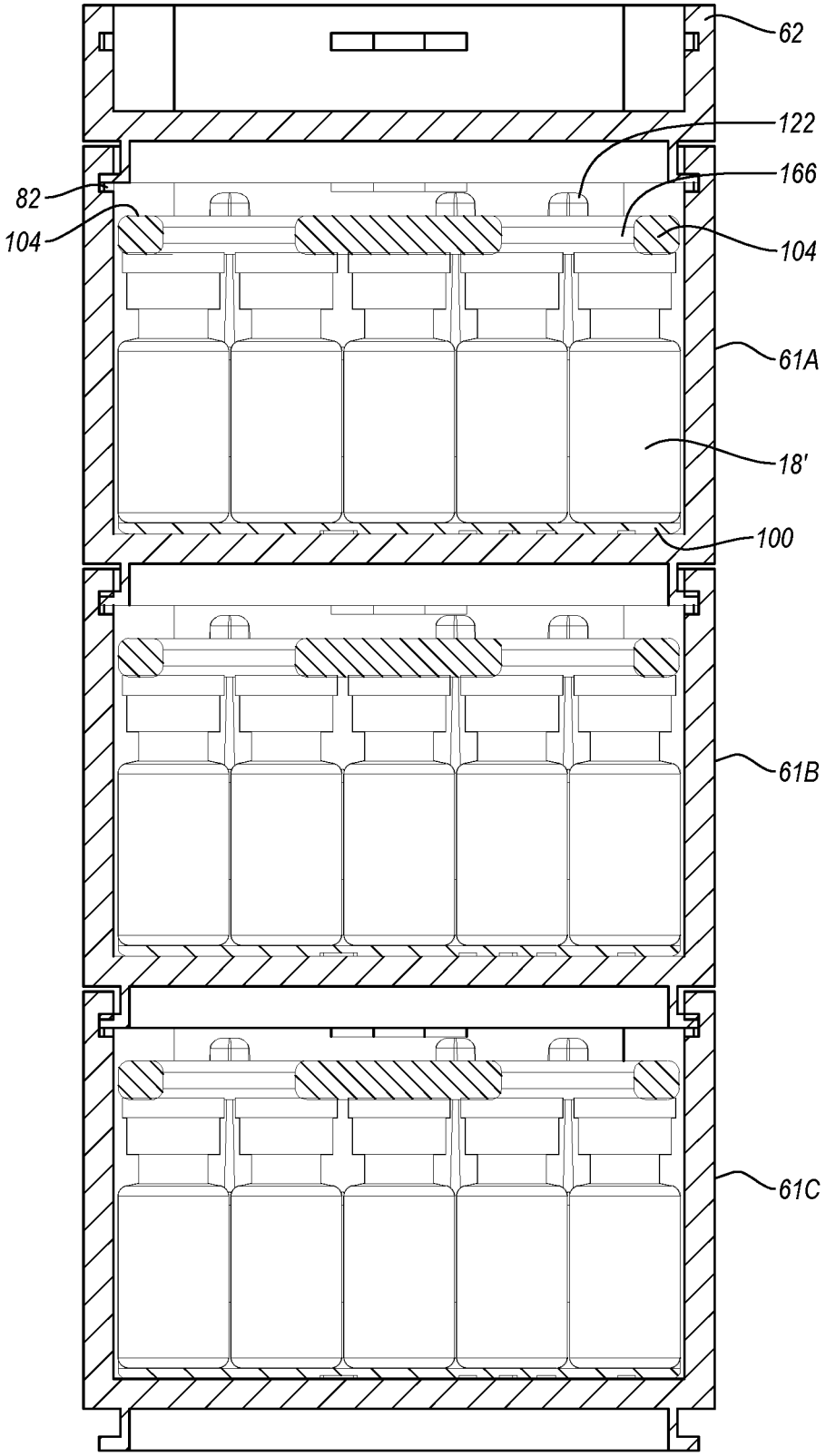
FIG. 15 is a cross sectional side view of the storage rack shown in FIG. 9.

As depicted in FIG. 15, retention plate 104 sits within compartment 80 of storage unit 61 so that top surface 104 is disposed below engagement notches 82. As a result, retention plate 104 does not interfere with locking between storage units 61 and between a storage unit 61 and lid 62.

In part, retention plate 104 functions to occupy space within the upper end of each compartment 80 of storage units 61. As a result, if container 12 rolls or is tipped over, retention plate 104 restrains or otherwise limits vertical movement of medicinal carriers 18' within compartment 80, thereby limiting potential damage to medicinal carriers 18'. It is appreciated that retention plates 104 can come in a variety of different thicknesses. For example, for medicinal carriers 18' of shorter height, thicker retention plates 104 may be desirable to occupy more space. In some embodiments retention plate 104 can have a maximum thickness that is greater than, smaller than, equal to, or in a range between any two 0.25 cm, 0.5 cm, 1 cm, 1.5 cm 2 cm, 3 cm, 4 cm, or 5 cm. In one embodiment retention plate 104 has a maximum dimension, which could be a width, length, diameter etc., that is greater than, smaller than, equal to, or in a range between any two of 8 cm, 12 cm 16 cm, 20 cm, 24 cm, or 28 cm. In contrast to using retention plates 104 of different thicknesses, it is appreciated that two, three, four or more retention plates 104 can be stacked on top of one another within compartment 80 so as to occupy a desired volume. The stacked retention plates 104 can each be the same thickness or can be different thicknesses. Thus, in some embodiments, two or more retention plates 104 can be used in a particular storage unit 61 to compensate for a set of medicinal carriers 18' which are less tall than the medicinal carriers 18' for which a particular tray 100 is normally used.

Retention plates 104 are typically made of a plastic or elastomeric material but foam or other cushioning materials could also be used. It is appreciated that retention plate 104 can come in a variety of different configurations but it is typically complementary to the transverse cross section of compartment 80. In other embodiments, handle openings 166 can be eliminated and replaced with a handle or other griping feature that is formed on or outwardly projects from one or both sides of retention plate 104.

Figure 16:
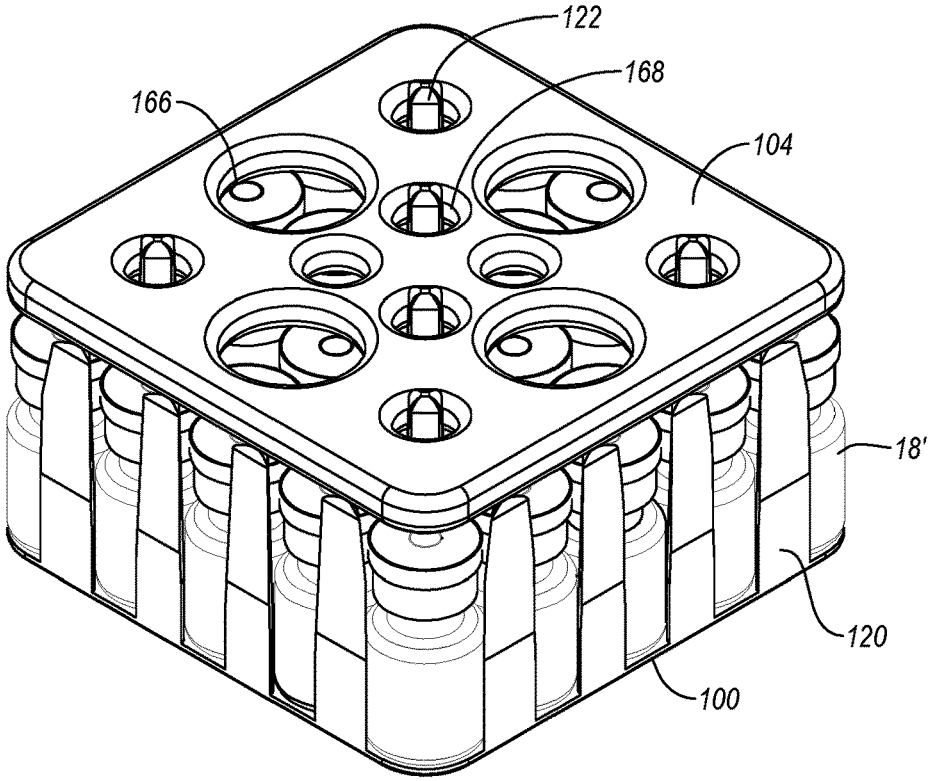
FIG. 16 is a perspective view of a tray housing medicinal carriers with the retention plate being supported on the primary spacer.
Figure 17:
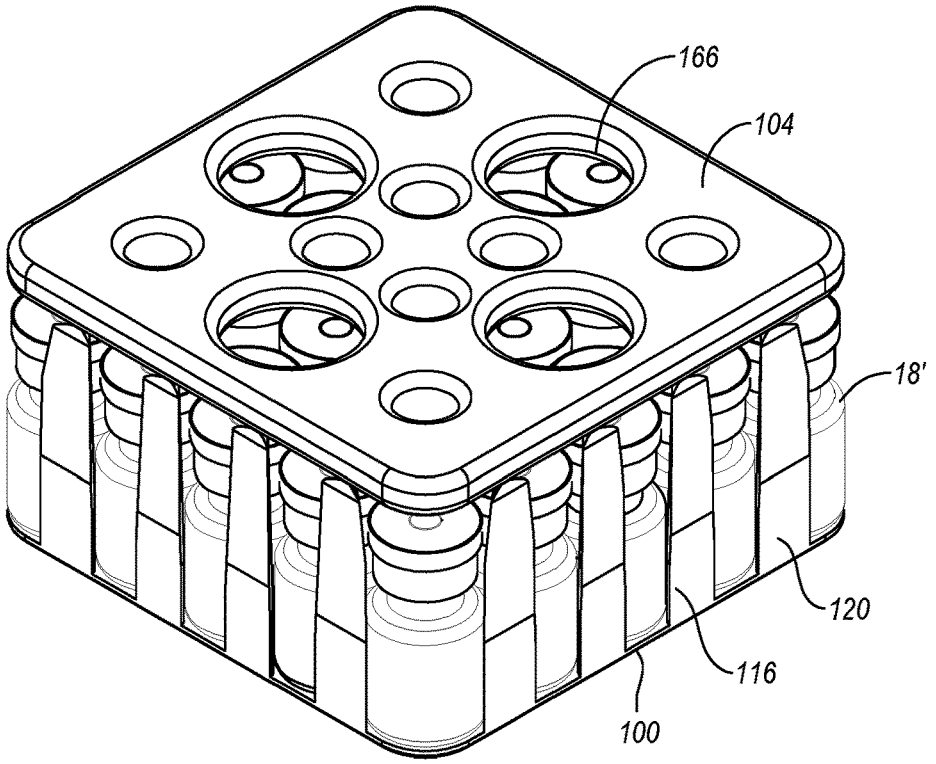
FIG. 17 is a perspective view of a tray housing medicinal carriers wherein engagement spacers have been replaced with primary spacers.
Figure 18:
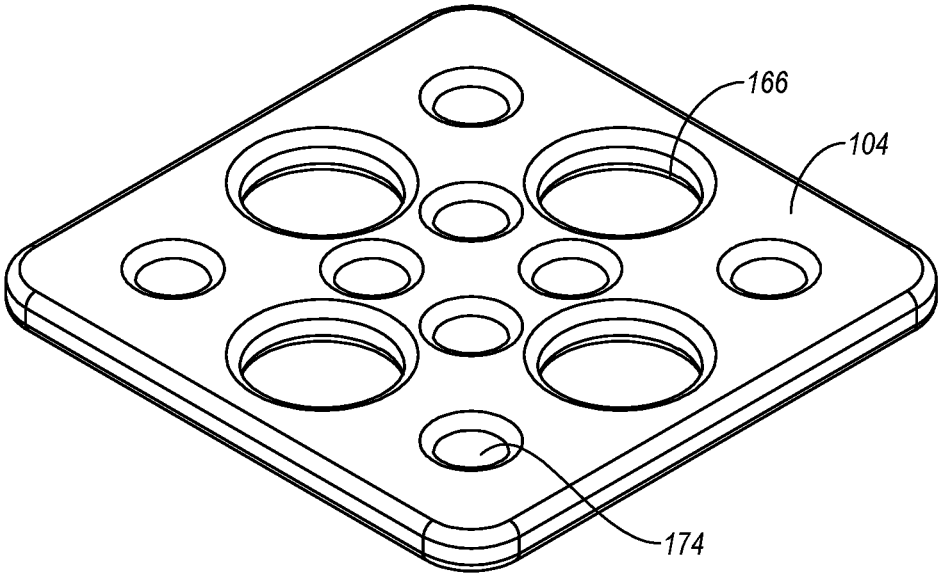
FIG. 18 is a perspective view of a tray housing medicinal carriers where the retention plate is configured to rest directly on top of the engagement spacers.
Figure 18:
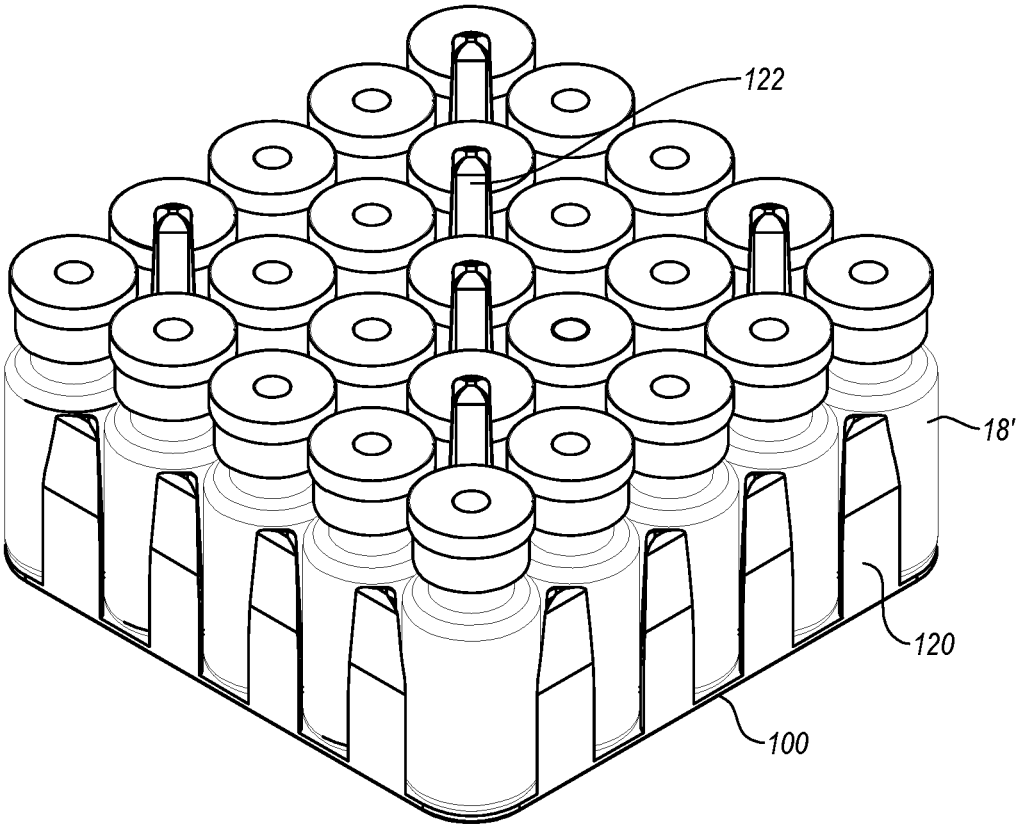

Depicted in FIG. 16, primary spacers 120 have been lengthened so as to extend above medicinal carriers 18'. In this embodiment, retention plate 104 rests directly on top of primary spacers 120 rather than resting on medicinal carriers 18'. However, engagement spacers 122 still extend through pass-through openings 168. In the embodiment depicted in FIG. 17, all engagement spacers 122 have been eliminated and replaced with other primary spacers 120. As such, no spacers extend through retention plate 104. In this embodiment, pass-through openings 168 have also been filled in or otherwise eliminated from retention plate 104. Finally, in the embodiment depicted in FIG. 18, engagement spacers 122 remain but pass-through openings 168 have been removed from retention plate 104 and replaced with corresponding recessed pockets 174 on each side. The rounded nose of each engagement spacer 122 is received within a corresponding pocket 174 but does not pass through retention plate 104. In this embodiment, retention plate is fully supported by engagement spacer 122.

In still other embodiments, in contrast to having a single tray 100 in each compartment 80 of a storage unit 61, storage units 61 could be made larger and 2, 3, 4 or more trays 100 could be stacked on top of each other within the single compartment 80. If desired, a retention plate 104 could be positioned between each pair stacked trays 100. Other embodiments are also envisioned.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A storage rack assembly for holding medicinal carriers comprising:

a first storage unit at least partially bounding a compartment and having an access opening that communicates with the compartment;

a first tray removably disposed within the compartment of the first storage unit, the first tray comprising:

a floor having a top surface; and a plurality of spacers upstanding from the top surface of the floor and being spaced apart so that the medicinal carriers can be positioned between the spacers, the plurality of spacers comprising a plurality of spaced apart primary spacers and a plurality of spaced apart engagement spacers, the engagement spacers having a length greater than a length of the primary spacers; and a first retention plate having a top surface and an opposing bottom surface with a plurality of openings extending therebetween, the first retention plate being at least partially disposed within the compartment of the first storage unit so that the first retention plate is disposed above the primary spacers and each engagement spacer projects through a corresponding one of the plurality of openings.

2. The storage rack assembly as recited in claim 1, wherein there are at least twice as many primary spacers as there are engagement spacers in the first tray.

3. The storage rack assembly as recited in claim 1, wherein there are at least three engagement spacers and at least sixteen primary spacers in the first tray.

4. The storage rack assembly as recited in claim 1, wherein the engagement spacers project above the first retention plate by a distance of at least 10 mm.

5. The storage rack assembly as recited in claim 1, further comprising a plurality of medicinal carriers disposed between the spacers, each medicinal carrier housing a medicinal preparation.

6. The storage rack assembly as recited in claim 5, wherein the first retention plate is resting on the plurality of medicinal carriers.

7. The storage rack assembly as recited in claim 1, further comprising:

a plurality of medicinal carriers disposed between the spacers, each medicinal carrier housing a medicinal preparation; and the first retention plate resting on top of the primary spacers and being spaced apart from the medicinal carriers.

8. The storage rack assembly as recited in claim 1, wherein the first retention plate is fully disposed within the compartment of the first storage unit.

9. The storage rack assembly as recited in claim 1, further comprising:

a second storage unit at least partially bounding a compartment and having an access opening that communicates with the compartment, the second storage unit being removably secured to the first storage unit so that the first storage unit and the second storage unit are vertically aligned;

a second tray removably disposed within the compartment of the second storage unit, the second tray comprising:

a floor having a top surface; and a plurality of spacers upstanding from the top surface of the floor and being spaced apart so that medicinal carriers can be positioned between the spacers.

10. A method of loading a passive cold storage container system, the method comprising:

placing a plurality of medicinal carriers on a first tray, the medicinal carriers being separated by a plurality of spaced apart spacers upstanding from a floor of the first tray, the plurality of spacers comprising primary spacers and engagement spacers, the engagement spacers being longer than the primary spacers;

positioning a first retention plate over the first tray so that the first retention plate rests on the medicinal carriers or the primary spacers and the engagement spacers project through openings extending through the first retention plate;

inserting the first tray supporting the medicinal carriers within a compartment of a first storage unit; and positioning the first storage unit that houses the first tray and the medicinal carriers into a storage area of a container, at least one heat sink module being disposed within the storage area.

11. The method as recited in claim 10, further comprising:

inserting the first tray supporting the medicinal carriers within the compartment of a first storage unit by manually inserting the first tray into the compartment while holding the first tray by grasping the engagement spacers.

12. The method as recited in claim 10, wherein the step of positioning the first retention plate occurs after the step of inserting the first tray in the compartment of the storage unit.

13. The method as recited in claim 10, wherein the first retention plate is fully positioned within the compartment of the first storage unit.

14. The method as recited in claim 10, further comprising:

securing the first storage unit to a second storage unit, the second storage unit having a compartment in which a second tray is disposed, a plurality of medicinal carriers being disposed on the second tray; and positioning the first storage unit into the storage area of the container when the first storage unit is connected to the second storage unit.

15. The method as recited in claim 10, further comprising removing the first tray supporting the medicinal carriers from the compartment of the first storage unit by manually grasping the engagement spacers and lifting the first tray out of the compartment.

16. A storage rack assembly for holding medicinal carriers comprising:

a first storage unit at least partially bounding a compartment and having an access opening that communicates with the compartment;

a first tray removably disposed within the compartment of the first storage unit, the first tray comprising:

a floor having a top surface; and a plurality of spacers upstanding from the top surface of the floor and being spaced apart, the plurality of spacers comprising a plurality of spaced apart primary spacers and a plurality of spaced apart engagement spacers, the engagement spacers having a length greater than a length of the primary spacers;

a plurality of medicinal carriers disposed between the spacers; and a first retention plate having a top surface and an opposing bottom surface with a plurality of openings extending therebetween, the first retention plate resting on the primary spacers or the medicinal carriers.

17. The storage rack assembly as recited in claim 16, wherein the first retention plate is resting on the primary spacers and is spaced apart from medicinal carriers.

18. The storage rack assembly as recited in claim 16, wherein the first retention plate is resting on the medicinal carriers and is spaced apart from primary spacers.

* * * * *